US005634422A

United States Patent [19]

Kobayashi et al.

[11] Patent Number: 5,634,422

[45] Date of Patent: Jun. 3, 1997

[54] PERSONAL WATERCRAFT WITH V-TYPE ENGINE

[75] Inventors: Noboru Kobayashi; Yoshiyuki Kaneko, both of Iwata, Japan

[73] Assignee: Yamah aHatsudoki Kabushiki Kaisha, Iwata, Japan

[21] Appl. No.: 480,193

[22] Filed: Jun. 7, 1995

Related U.S. Application Data

[62] Division of Ser. No. 195,354, Feb. 10, 1994, Pat. No. 5,511,505.

[30] Foreign Application Priority Data

Feb. 15, 1993 [JP] Japan ..... 5-25811

[51] Int. Cl.[6] ..... B63B 35/00

[52] U.S. Cl. ..... 114/270; 114/363

[58] Field of Search ..... 114/270, 363

[56] References Cited

U.S. PATENT DOCUMENTS

| | | | |
|---|---|---|---|
| 2,808,892 | 10/1957 | Walker . | |
| 3,948,206 | 4/1976 | Tyler . | |
| 3,981,321 | 9/1976 | Risse et al. . | |
| 4,768,983 | 9/1988 | Smith | 114/270 |
| 4,787,344 | 11/1988 | Okumura et al. . | |
| 4,824,409 | 4/1989 | Kobayashi . | |
| 4,930,476 | 6/1990 | Oguri et al. . | |
| 4,951,465 | 8/1990 | Torigai . | |
| 5,234,364 | 8/1993 | Ito . | |
| 5,320,059 | 6/1994 | Ikeda | 114/363 |

*Primary Examiner*—Jesus D. Sotelo

*Attorney, Agent, or Firm*—Knobbe, Martens, Olson & Bear LLP

[57] ABSTRACT

A number of embodiments of small personal watercraft each embodying a V-type engine. Arrangements are shown wherein the engine is mounted either with its output shaft extending in a longitudinal direction or in a vertical direction. Various placements for the engine are disclosed and in all embodiments a straddle-type seat is incorporated for accommodating at least the rider and in some instances additional passengers. Various types of exhaust systems including watertrap devices are incorporated and the watercraft is provided with a pair of fuel tanks in several embodiments that are disposed in longitudinal alignment with the seat and on opposite sides thereof for improving balance.

100 Claims, 22 Drawing Sheets

PERSONAL WATERCRAFT WITH V-TYPE ENGINE

This application is a divisional of U.S. patent application Ser. No. 08/195,354, filed Feb. 10, 1994, by the same inventor, now U.S. Pat. No. 5,511,505.

BACKGROUND OF THE INVENTION

This invention relate to an improved type of watercraft and more particularly to an improved personal watercraft with a V-type engine.

There is a very popular type of watercraft known as a "personal watercraft" which is designed to be operated primarily by a single rider. Although this type of watercraft is commonly employed for single riders, frequently provisions are made for accommodating additional passengers although the maximum number of passengers is more limited than conventional types of watercraft.

This type of watercraft is also generally quite sporting in nature and normally accommodates at least the rider on a type of seat in which the rider sits in a straddle fashion. The passenger's area is frequently open through the rear of the watercraft so as to facilitate entry and exit of the rider and passengers to the body of water in which the watercraft is operating as this type of watercraft is normally employed with passengers that are wearing swimming suits.

These personal watercraft are generally quite small so that they can be conveniently transported from the owner's home to a body of water for its use. Because of the small size, the layout of the components is extremely critical and this gives rise to several design considerations that are peculiar to this type of watercraft. However, due to the sporting nature it is also desirable if the watercraft can be powered by an engine and propulsion device that have high powers and efficiency.

Normally this type of watercraft has been powered by an inline type of engine. However, in order to improve the performance of the engine it is desirable to increase the number of cylinders in the engine. With inline engines, the use of more than three cylinders can give rise to considerable space requirements due to the elongation of the engine. Although V-type engines are more compact in some regards, the angle between the cylinder banks give these engines a substantial degree of width. This itself presents certain problems in locating the engine, particularly in conjunction with a small personal type watercraft.

It is, therefore, a principal object of this invention to provide an improved personal watercraft that is powered by a V-type engine.

It is a further object of this invention to provide a small watercraft of the type having a seat in which the rider is seated in a straddle fashion and which can be powered by a V-type of engine.

In watercraft of the type already described, because of the small nature of the watercraft it is extremely important to provide good balance under all conditions. This is particularly true when the watercraft is designed so as to accommodate more than one passenger. One-way in which balance has been obtained is to try to concentrate all of the heavier objects of the watercraft on its longitudinal centerline. However, this gives rise to problems in fore and aft weight distribution and also can present spatial difficulties particularly when using a straddle-type seating arrangement.

It is, therefore, a still further object of this invention to provide an improved component of layout for a small watercraft.

It is a further object of this invention to provide a fuel tank arrangement for a personal watercraft that will assist in maintaining balance under all conditions or substantially all conditions and which will still afford a large fuel capacity.

As has already been noted, these personal watercraft normally employ straddle-type seats that will accommodate one or more passengers. However, if more than three passengers are to be accommodated, then the tandem-type seat can dictate a larger size for the watercraft than is desired. However, side-by-side seating also is not particularly desirable with this type of watercraft as it may unduly increase the width of the hull and diminish its performance. In addition, there are advantages to having the rider sit in a straddle fashion as it permits his center of gravity to be raised and he can facilitate the handling of the watercraft by leaning the hull when maneuvering.

It is, therefore, a still further of this invention to provide an improved seating arrangement for a personal watercraft that will permit the use of a straddle-type seat for the rider but which will also afford additional seating for added passengers without increasing the length of the watercraft.

It is a further object of this invention to provide an improved seating arrangement for this type of watercraft.

It should be readily apparent from the foregoing description that personal watercraft of the type described tend to be extremely compact and spartan in nature. However, there are numerous occasions when the rider or passengers may wish to carry with them additional objects. However, due to the sporting nature of this type of watercraft, the objects cannot be easily carried within the passenger compartment. However, the compact nature of the hull and the provision for the propulsion device powering engine and engine accessories does not afford significant storage areas within the hull.

It is, therefore, a still further object of this invention to provide an improved personal watercraft hull configuration that will permit a compact nature and still afford one or more storage compartments.

It is a further object of this invention to provide an improved storage compartment configuration for a personal watercraft wherein the storage compartment makes use of space otherwise wasted in the watercraft.

The type of personal watercraft which has been described herein is frequently powered by a jet propulsion unit which jet propulsion unit is positioned at least in part within a tunnel formed at the rear of the underside of the hull of the watercraft. This affords a very neat appearance but adds to the difficulties in providing a compact construction which will accommodate all of the needs aforenoted.

The jet propulsion unit includes an impeller that is driven by an impeller shaft that extends forwardly through the tunnel and through a bulkhead formed at the front of the tunnel for connection to the internally mounted powering engine of the hull. However, in order to improve weight balance and to provide more usable space, frequently it is desirable to position the engine at a point well forward of the forward bulkhead of the tunnel. This gives rise to long, unsupported shafts.

It is, therefore, a still further of this invention to provide an improved driving arrangement for a jet propulsion unit of a personal watercraft.

It is a further object of this invention to provide an improved bearing arrangement for the drive shaft of a jet propelled personal watercraft that affords adequate bearing support throughout the length of the driving arrangement.

As has been noted, the personal watercraft of the type which have been described are quite sporting in their nature. In fact, it is not uncommon for this type of watercraft to occasionally capsize. As with all watercraft, this can present some particular problem, particularly with the engine and its exhaust system. It is normally the practice in watercraft to discharge the exhaust gases from the engine either into the atmosphere through the body of water in which the watercraft is operating or at a point quite close to the water level. Hence, extreme alterations in the hull orientation can cause water easily to flow through the exhaust system to the engine. In addition, it is often the practice to discharge the cooling water from the engine back to the body of water in which the watercraft is operating through its exhaust system. This gives rise to further possibilities for water to flow to the engine through the exhaust system under abrupt changes in hull attitude.

It is, therefore, a still further object of this invention to provide an improved exhaust system for a watercraft in which the configuration is such so as to discourage water from flowing to the engine through the exhaust system if the hull changes its attitude.

It is a further object of this invention to provide an improved exhaust system for a personal watercraft wherein the exhaust system is configured to reduce the likelihood of water reaching the engine through the exhaust system, even if the watercraft becomes capsized.

In watercraft that incorporate multiple cylinders there are some advantages in employing separate exhaust pipes for groups of cylinders to achieve desired exhaust tuning. In addition, if the engine is disposed so that it has the cylinders arranged in angularly related banks, it is quite common practice to employ separate exhaust systems for each bank of cylinders. This gives rise to further problems in connection with assuring that water will not flow to the engine through the exhaust system, particularly if the watercraft is either capsized or has its orientation significantly altered from the normal operation orientation.

It is, therefore, a still further object of this invention to provide an improved watercraft system for a watercraft powered by a V-type engine.

In order to protect the engine from ingesting water through the exhaust system, it is a common practice to provide a water trap device in the exhaust conduit which discharges the exhaust gases from the engine exhaust ports to the atmosphere. These water trap devices are designed not only to separate water from the exhaust gases when the water is discharged from the engine cooling system through the exhaust system but also to ensure that water which may enter the exhaust pipes may be trapped before it can reach the exhaust port.

In order to be effective, these water trap devices must have some significant volume and this additionally places further problems on the designer in laying out all components of the personal type of watercraft.

It is, therefore, a still further object of this invention to provide an improved water trap arrangement for a personal watercraft.

It is a further object of this invention to provide an improved component layout for a personal watercraft wherein the components including the water trap are located so as to provide a stable center of gravity for the watercraft under all conditions.

In order to permit the components for the watercraft including the water trap device to be located to maintain the desired balance for the hull, this frequently can dictate the positioning of the water trap device in a location where the exhaust gases would not normally pass. For example, it may be desirable to position the water trap device in the front of the engine even though the exhaust gases are discharged rearwardly. This gives rise to additional problems in locating all of the components including the exhaust conduitry to have the exhaust gases flow forwardly to the water trap and then rearwardly for discharge.

It is, therefore, a still further object of this invention to provide improved component layout and exhaust system for a watercraft wherein the water trap device may be positioned in a location where the exhaust gases would not normally flow and the exhaust conduitry can deliver the exhaust gases in the desired flow path without encroaching on other components of the watercraft.

As has been previously noted, the personal watercraft of the type described are sporting in nature and frequently the rider and/or passenger may wish to exit the watercraft to enter the body of water in which the watercraft is operating or to enter the watercraft of the body of water in which the watercraft is operating. Frequently, the riders compartment is positioned to the rear of the hull and opens through the rear of the hull to facilitate such reentry. However, to assure ease of entry it is desirable that the rear portion of the watercraft be relatively low to be accessible from the body of water in which the watercraft is operating. This means that any rearwardly positioned seats if they have seat backs will interfere with such entry. However, it is also desirable, particularly for a rearwardly seated passenger to have a backrest so as to provide comfort and some degree of security. However, a backrest can make reentry of the watercraft difficult, as should be readily apparent.

It is, therefore, a still further object of this invention to provide an improved backrest arrangement for the rear seat of a personal watercraft which can be moved to facilitate reentry.

It is a further object of this invention to provide a rear seat back for the rear seat of a personal watercraft which can also function as a boarding ladder so as to move the seat back out of the way and for entry and also to assist in entry.

It should be readily apparent from the foregoing description that the small personal watercraft of the type described present a number of problems in accommodating passengers and laying out of the various components. One thing that may be desirable with this type of watercraft is to provide a forward deck area on which riders may lie for sunbathing or the like. Of course, because of the extremely short desirable length for such watercraft, this is not always feasible.

It is, therefore, a still further object of this invention to provide a hull configuration for a small watercraft wherein the deck area may be used by a rider for sunbathing.

SUMMARY OF THE INVENTION

A first feature of the invention is adapted to be embodied in a personal type of watercraft that has a hull which is provided with a straddle-type seat that is adapted to accommodate at least one rider seated thereon in straddle fashion. A propulsion device for propelling the watercraft is powered by an internal combustion engine that is carried within the hull. The engine has at least a pair of cylinder banks that are disposed at an angle to each other.

In accordance with some embodiments of the invention, the engine is disposed so that the output shaft rotates about a longitudinally extending horizontally disposed axis. In other embodiments, the engine is mounted so that its output shaft rotates about a vertically extending axis. When rotating about a vertically extending axis, the cylinder banks are disposed either so that the valley between them faces forwardly or rearwardly depending upon the location at which the engine is positioned in the watercraft to improve space utilization. In some embodiments, the engine is positioned beneath the control area of the watercraft and in other embodiments the engine is located at least in part beneath the seat. When the engine is positioned beneath the seat, the seat has a removable portion for facilitating accessing of the engine.

Another feature of the invention is also adapted to be embodied in a personal type of watercraft that has a hull which provides a straddle-type seat that is adapted to carry at least one rider seated thereon in straddle fashion. A propulsion device is provided for propelling the watercraft and is driven by an internal combustion engine that is carried by the hull. In accordance with this feature of the invention, a pair of fuel tanks are carried by the hull on opposite sides of a longitudinally extending centerline and means deliver the fuel from the fuel tank to the engine for improving side-by-side balance as fuel is consumed.

In accordance with this feature of the invention, in some embodiments the fuel tanks are aligned with the seat so as to avoid differences in fore and aft balance as the fuel is consumed. In addition, arrangements are incorporated for interconnecting the two fuel tanks so as to permit the fuel to be drawn from them simultaneously until a predetermined level is reached and then each fuel tank contains a remaining amount of fuel that can function as an emergency supply. Also, in accordance with this feature of the invention, the fill neck for the fuel tank may be positioned to the rear of the watercraft with an adjacent deck area so as to facilitate refueling.

Another feature of the invention is also adapted to be embodied in a personal-type watercraft having a hull provided with a straddle-type seat that is adapted to carry at least one rider seated thereon in straddle fashion. A propulsion device is provided for propelling the watercraft and is driven by an internal combustion engine carried in the hull. A pair of passenger seats are each disposed on a respective side of the straddle-type seat at the rear thereof and at a substantially different level so that passengers seated thereon would be seated at different heights than the rider seated on the straddle-type seat.

Another feature of the invention is adapted to be embodied in a watercraft that is comprised of a hull defining a rider's area which contains a raised central seat for accommodating at least one rider seated in straddle fashion. A pair of foot areas are disposed on opposite sides of the seat and on which a rider may place his feet. At least one storage compartment is disposed within the hull beneath one of the foot areas.

A further feature of the invention is adapted to be embodied in a water craft comprised of a hull defining a tunnel at the rear end and on the underside thereof. A rider's area is disposed above the tunnel in the upper portion of the hull. A straddle-type seat is positioned centrally of the rider's area and is adapted to accommodate at least one rider seated in a straddle fashion. A pair of foot areas are defined at the lower portion of the rider's area for receiving the feet of a rider seated on the seat. A jet propulsion unit is positioned at least in part in the tunnel and has an impeller shaft. The tunnel is defined at the forward end thereof by the first bulkhead. An engine compartment is formed forwardly of the tunnel within the hull and is defined at the rear end thereof by a second bulkhead. An engine is disposed in the engine compartment and has an output shaft. A drive shaft is coupled at one end to the engine output shaft and at the other end to the impeller shaft for driving the impeller shaft from the engine output shaft. First and second bearings are supported the first and second bulkheads, respectively, for journaling the drive shaft.

A still further feature of the invention is adapted to be embodied in an exhaust system for a watercraft having a hull. Engine means are disposed within the hull with at least two cylinders having exhaust ports opening on opposite sides of a longitudinal plane passing through the center of the hull. The exhaust ports are positioned substantially forwardly of a transom of the hull. A propulsion device is driven by the engine means and is supported within the hull for propelling the watercraft. An exhaust system collects exhaust gases from the exhaust ports and discharges them to the atmosphere at a point contiguous to the transom and the longitudinal plane.

In accordance with some embodiments of the invention described in the preceding paragraph, the exhaust system comprises separate exhaust pipes for each side of the engine. In some embodiments, the exhaust pipes have discharge openings that face each other and in some embodiments the exhaust pipes on one side of the longitudinal plane cross over and terminate on the other side of the longitudinal plane. The engine means may be of the V-type and can be positioned so that its output shaft rotates about either a horizontally disposed longitudinal axis or a vertically disposed axis.

Another feature of the invention is also adapted to be embodied in an exhaust system for a watercraft having a hull and an engine compartment formed within the hull. Engine means are disposed within the engine compartment with at least two cylinders having exhaust ports opening on opposite sides of the longitudinal plane passing through the center of the hull. The exhaust ports are positioned substantially forwardly of a transom of the hull. A propulsion device is driven by the engine and is supported within the hull for propelling the watercraft. An exhaust system collects exhaust gases from each of the exhaust ports and discharges them to the atmosphere on a side of the longitudinal plane opposite to the side on which the exhaust port opens.

In accordance with embodiments of an invention as described in the preceding paragraph, the exhaust system comprises separate exhaust pipes for each side of the engine means. In all embodiments described, the engine is of the V-type and in some embodiments, it is disposed with its crankshaft rotating about a longitudinally extending horizontal axis and in other embodiments the engine is supported so that its output shaft rotates about a vertical axis. A number of variations of water trap devices may also be employed in the exhaust system and these water trap devices are located so as to improve the balance of the watercraft.

Another feature of the invention is adapted to be embodied in a watercraft which is comprised of a hull and a propulsion device that is carried by the hull for propelling the watercraft. An internal combustion engine is positioned within the hull and drives the propulsion device. An exhaust system is incorporated for discharging exhaust gases from an exhaust port of the engine to the atmosphere and this exhaust system comprises conduit means extending from the engine to a water trap device carried within the hull and positioned between the exhaust port of the engine and one end of the hull. The conduit means further comprises a discharge end that is positioned rearwardly of the engine and through the hull. A fuel tank for the engine is positioned within the hull and is disposed between the exhaust port and the other end of the hull for balancing the watercraft device.

A further feature of the invention is adapted to be embodied in a watercraft that is comprised of a hull, a propulsion device carried by the hull for propelling the water shaft and an internal combustion engine positioned within the hull and driving the propulsion device. The engine has at least one exhaust port on one side thereof for discharging exhaust gases. A water trap device is positioned within the hull on a side of the engine opposite to the exhaust port. First exhaust conduit means extends from the exhaust port over the top of the engine for delivering exhaust gases from the engine exhaust port to the water trap device. Second exhaust conduit means extend from the water trap device to an opening in the hull for discharging exhaust gases to the atmosphere.

In some embodiments of the invention as described in the preceding paragraph the engine is positioned so that the exhaust port and the first conduit means is positioned beneath a control area for the watercraft. In other embodiments, the exhaust port and first exhaust conduit means are disposed beneath a seat of the watercraft. Thus, these embodiments facilitate the positioning of the first exhaust conduit without encroaching on other areas.

Another feature of the invention is adapted to be embodied in a watercraft that is comprised of a hull having a riders area at the rear thereof. A seat is positioned adjacent a transom of the hull. A boarding ladder is supported by the hull for movement between a lowered position depending into the body of water in which the watercraft is operating for assisting boarding of the watercraft and a raised position in which it forms a back portion for a rider seated upon the seat.

A still further feature of the invention is adapted to be embodied in a watercraft which is comprised of a hull defining a rider's area at the rear thereof. A steering control is positioned forwardly of the rider's area for steering of the watercraft by a rider in the rider area. A deck extends forwardly from the steering control and is configured to accommodate a passenger laying thereon. Cushion means are associated with the steering control on which the lying passenger may rest his head.

DETAILED DESCRIPTION OF THE PREFERRED EMBODIMENTS OF THE INVENTION

Figure 1:
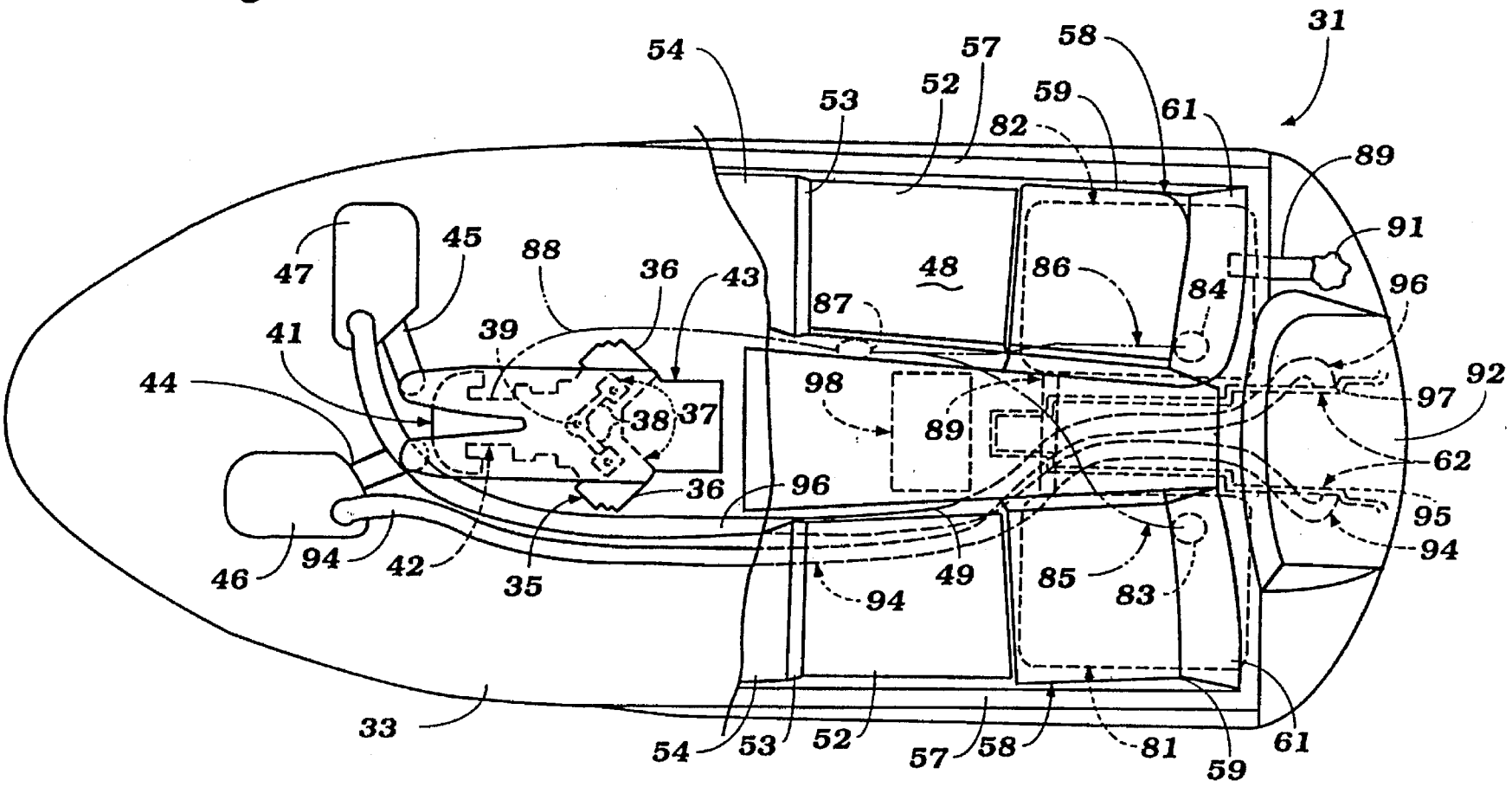
FIG. 1 is a top plan view of a personal watercraft constructed in accordance with a first embodiment of the invention, with the forward portion broken away so as to show the engine compartment and the components positioned therein.

Before referring in detail to each of the embodiments, it should be noted that the various embodiments disclosed all contain a number of components which are the same or substantially the same. Where that is the case, the construction will be described initially by reference to the embodiment in which it first appears and in describing subsequent embodiments, parts which are the same or substantially the same will be identified by the same reference numerals. If the elements or construction is the same as in a previously described embodiment but is only oriented in a different fashion, it also will be identified by the same reference numerals. Therefore, if a component is described in one embodiment and that component is in the same location and of the same construction in a subsequent embodiment, the component may not be illustrated as only the differences between the subsequent embodiments are illustrated generally. Any components which are not illustrated or described, may be considered to be conventional in the art and those skilled in the art can readily understand how conventional components may be employed so as to achieve the desired result.

Figure 2:
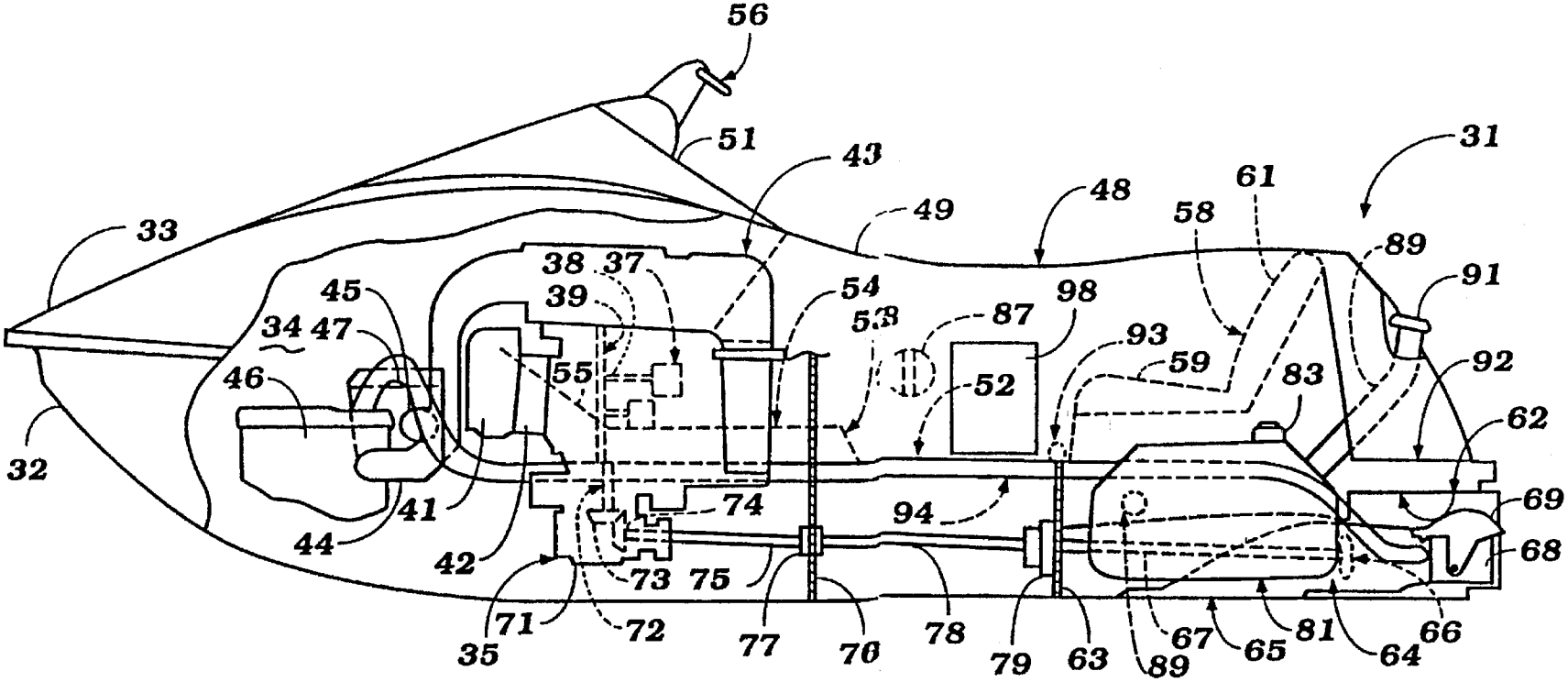
FIG. 2 is a side elevational view of this embodiment, with portions broken away so as to more clearly show the construction.

Referring now to the first embodiment, which is illustrated in FIGS. 1 and 2, a watercraft constructed in accordance with this embodiment is indicated generally by the reference numeral 31. The watercraft 31 is of the small personal watercraft type, although certain features of the invention may be employed with other types of watercraft. In all instances, the inventive features have particular utility, however, in small personal type watercraft.

The watercraft 31 is comprised of a hull having a lower hull portion 32 and an upper deck portion 33 which is connected to the hull portion 32 in any known manner. The hull portion 32 and deck portion 33 are formed from a suitable material such as a molded fiberglass reinforced resinous plastic or the like.

The forward portion of the hull 32 and deck 33 define an engine compartment, indicated generally by the reference numeral 34 in which an internal combustion engine, indicated generally by the reference numeral 35 is mounted. In this embodiment, as with all of the embodiments which will be described, the engine 35 is of the V4-type and operates on a two-cycle crankcase compression principle. Although the invention may be employed in conjunction with engines having other numbers of cylinders than four, and also certain facets of the invention may be employed with inline type engines, the invention has particular utility with V-type engines.

The engine 35 is comprised of a cylinder block that defines a pair of angularly related cylinder banks 36 having cylinder bores in which pistons 37 are supported for reciprocation. The pistons 37 are connected by means of connecting rods 38 to a crankshaft 39 that is rotatably journaled within a crankcase chamber formed by the cylinder block and a crankcase member which is affixed to the cylinder block. As is typical with two-cycle crankcase compression engines, the crankcase chambers associated with each of the cylinder bores are sealed from each other in a suitable manner. In this embodiment, the engine 35 is supported so that the crankshaft 39 rotates about a vertically extending axis. This provides a more compact assembly and also permits the watercraft to be relatively narrow since the cylinder banks 36 diverge rearwardly so that the valley formed between the cylinder banks faces in a rearward or stern direction.

The engine 35 is provided with an induction system that extends forwardly within the engine compartment 34 and this includes an air inlet device 41 which draws atmospheric air from within the engine compartment 34 and delivers it to the crankcase chambers of the engine 35 through an intake manifold 42. Any known type of charge forming system may be employed for mixing fuel with the inducted air. For example, there may be provided carburetors, manifold type fuel injection or direct cylinder type injection. The exact components utilized for this purpose have no significance to the invention, although the invention does relate to the layout of certain components of the engine 35 and the disposition of the engine 35 within the watercraft 31.

As is well known with two-cycle engine practice, the charge which is delivered to the crankcase chambers is transferred to the combustion chambers of the engine and is fired by a suitable ignition system, assuming the engine 35 is of the spark-ignited type. It should also be apparent to those of skill in the art that the invention may be employed in conjunction with engines operating on the diesel cycle. Also, the invention may be utilized with four-cycle as well as two-cycle engines.

In this embodiment of the invention, the exhaust ports for the engine 35 are disposed in the valley between the cylinder banks 36. These exhaust ports communicate with a combined expansion chamber and exhaust manifold 43 which has a portion that extends vertically to the rear of the engine in the area of the valley between the cylinder banks 36 and then extends across the top of the engine 35 and forwardly within the engine compartment 34. As is well known in the watercraft constructions, the engine 35 may also be water cooled by drawing water from the body of water in which the watercraft 31 operates in a known manner and circulating it through the cooling jackets of the engine 35. As is typical with watercraft practice, this coolant is then discharged back to the body of water in which the watercraft is operating by introducing it to the exhaust system at some point along its length. This water may be introduced in its expansion chamber 43 or at any other known location.

At the forward end of the engine 35 (forwardly of the crankcase in this embodiment), the expansion chamber device 43 has a pair of discharge conduits 44 and 45 which discharge the exhaust gases to water trap devices 46 and 47, respectively. The water trap devices 46 and 47 are disposed forwardly within the engine compartment 34 in an otherwise void area and thus their forward positioning improves the weight balance of the watercraft and space utilization. The water trap devices 46 and 47 are provided with internal baffles and sufficient volume so as to provide silencing for the exhaust gases and also to preclude water from flowing to the engine through the exhaust system and particularly the expansion chamber 43. This type of construction is well known in the art and, for that reason, further description of it is not believed to be necessary.

The exhaust gases are delivered to the atmosphere from the water trap devices 46 and 47 in a manner which will be described.

It should be noted that the deck portion 34 is provided with a removable hatch cover and certain of the later described embodiments illustrate hatch covers of the type that may also be employed in conjunction with this embodiment. This hatch cover permits access to the engine 35 and water trap devices 46 and 47 for servicing and other purposes.

The hull of the watercraft 31 and specifically the upper deck portion 33 forms a passenger or rider compartment 48 which is disposed rearwardly of the engine compartment 34 although it slightly overlies it, as will become apparent. This passenger compartment is defined by a generally elevated straddle-type seat 49 that extends rearwardly from a control portion 41 of the deck portion 33 and centrally of the passenger compartment 48. The seat 49 is adapted to accommodate a rider, operator seated in straddle fashion thereon. In addition, the seat 49 has sufficient length so as to accommodate a second rider seated in straddle tandem fashion behind the rider, operator.

A pair of foot areas 52 are formed on opposite sides of the seat 49 on which these riders may place their feet. At the forward end of these foot areas 52, there are provided upwardly inclined portions 53, for a purpose which will be described and which then terminate at forwardly extending portions 54 that also extend generally horizontally. These forward foot portions 54 are disposed so that the rider, operator may place his feet thereupon with inclined ramps 55 being formed forwardly thereof which also afford another area where the rider, operator may place his feet.

A control steering mast 56 is mounted on the control area 51 and affords an opportunity for steering the watercraft, in a manner which will be described. This steering mass 56 may also contain other controls such as a throttle control, reverse transmission control, etc., as is well known in this art.

The outer edge of the foot areas comprised of the portions 54, 53, and 52 are protected by raised gunnels 57 at the outer peripheral edges of the watercraft 31 and which gunnels may have a height substantially equal to the height of the straddle-type seat 49.

A further pair of passenger seats 58 are positioned on opposite sides of the rear portion of the straddle-type seat 49 within the passenger compartment 48. These seats 58 have cushion portions 59 and backrest portions 61 and will accommodate a pair of riders that are seated at opposite sides of the watercraft so as to accommodate side-to-side balance. These riders may place their feet in the foot areas 52 and against the inclined portions 53 for bracing purposes. It should be noted that the seat cushion portions 59 are substantially below the straddle-type seat 49 so that passengers seated thereon will have their heads disposed a substantially lower distance than the head of the rider, operator. This affords comfort for the riders. In addition, the straddle-type seat 49 extends along the inner side of the seat 58 and thus the riders also will have lateral support both from the straddle-type seat 49 and the raised gunnels 57.

It should be noted that the described seating arrangement permits one, two, three, or possibly four passengers all to be carried with good comfort and without disturbing side-to-side balance. That is, one or two riders may sit on the straddle-type seat 49 while three riders may be seated with one as the operator on the straddle-type seat 49 and the two passengers in the side seats 58. A fourth rider can also sit on the straddle-type seat 49. Thus, any number of passengers from one through four can be accommodated without disturbing the side-to-side balance.

The rear of the hull portion 32 is provided with a centrally located tunnel 62 that is defined by a pair of facing side walls and a forwardly disposed bulkhead 63. A jet propulsion unit, indicated generally by the reference numeral 64 is mounted in any well known manner in this tunnel 62 for propelling the watercraft 31. This jet propulsion unit includes a downwardly facing water inlet opening 65 defined by its housing and through which water is drawn by means of an impeller 66 that is journaled within an impeller portion on an impeller shaft 67 in a well known manner. This impeller shaft 67 is driven from the engine 35 in a manner which will be described.

The water thus pumped is discharged through a discharge nozzle portion to a steering nozzle 68, that is pivotally supported by the jet propulsion unit about a vertically extending pivot axis for steering by the handlebar 56 in a well known manner so as to control the direction of travel of the watercraft 31. A reverse thrust bucket 69 is mounted on the steering nozzle 68 and is operated by a remote operator positioned in the control area 51 for reversing the direction of travel of the watercraft 31, as is also well known in this art.

As has been noted, the engine 35 drives the impeller shaft 67 of the jet propulsion unit 64 for powering of the watercraft 31. Because of the vertical disposition of the engine crankshaft 39, there is provided a transfer gear transmission case 71 disposed on the lower end of the crankcase and into which the crankshaft 39 depends. The crankshaft 39 drives an input shaft 72 through a spur gear transmission which input shaft 72 also rotates about a vertically extending axis. A bevel gear 73 is affixed for rotation with the lower end of the input shaft 73 and engages a further bevel gear 74 that is connected to an output shaft 75 which rotates about a generally longitudinally extending horizontal axis.

The rear of the engine compartment 34 is closed by a bulkhead 76 and this bulkhead 76 carries a first bearing 77 that rotatably journals a drive shaft 78 that is coupled in a suitable manner to the output shaft 75. The rear end of the drive shaft 78 is coupled to the impeller shaft 67 in a known manner and is further journaled by a bearing 79 affixed to the bulkhead 63. Hence, although the drive shaft 78 is relatively long, it is journaled along its length by the bearing 76 and 79 and good rotational support will be achieved. Also, the bulkhead 76 defines an area beneath the foot areas 52 and forwardly of the bulkhead 63 that can be used for storage compartments, as will become apparent by description of later embodiments which illustrate this type of arrangement in more detail.

A pair of fuel tanks 81 and 82 are disposed in areas formed to the rear of the bulkhead 63 and beneath the passenger seats 58. These fuel tanks 81 and 82 have their lower surfaces somewhat inclined to the rear and pickup devices 83 and 84 depend into the rear of these fuel tanks 81 and 82, respectively, and are connected by means of respective conduits 8B and 86 to a selector valve 87 that is mounted on the side of the straddle-type seat 48 beneath the rider, operator. This selector type valve 87 permits the operator to select which fuel tank 81 or 82 will supply fuel to the engine through a supply line 88.

However, to ensure good side-to-side balance, there is provided a transversely extending interconnecting pipe 89 that extends between the fuel tanks 81 and 82 and across the tunnel area 62 at the forward ends of the fuel tanks 81 and 82. It should be noted that the communication conduit 89 is disposed above the inlet portion of the jet propulsion unit 64 and also above the lower ends of the fuel tanks 81 and 82. Hence, regardless of which fuel tank the operator selects by the selector valve 87, fuel will be drawn from both fuel tanks until the level drops below that of the interconnecting conduit 89. Thus, during the initial consumption of fuel, side-to-side balance will be maintained since fuel will be drawn substantially equally from both tanks 81 and 82, regardless of which tank is selected by the selector valve 87. Also, the fuel tanks 81 and 82 are located fairly close to the passenger's seat 49 and hence balance will not be upset from fore to aft as fuel is consumed. Also, the fuel tanks 81 and 82 are disposed on the opposite sides of the exhaust ports of the engine 3B from the water trap devices 46 and 47 so that fore and aft balance in the watercraft will also be improved.

When the fuel level is depleted in the fuel tanks 81 and 82 down to the line of the interconnecting conduit 89, then there will remain some fuel in each fuel tank 81 and 82 so as to provide a reserve supply. At this time, the operator by operating the selector valve 87 may draw fuel for reserve purposes from either or both fuel tanks so as to ensure that he can reach his destination.

A fill neck 89 is connected to one of the fuel tanks (the tank 82 in this embodiment) and extends rearwardly to a filler cap 91 at the transom of the watercraft. A small deck area 92 is provided rearwardly of the passenger compartment 48 and thus the tanks may be refueled by a person standing on this deck 92 very conveniently.

As has been noted in the introductory portion of this application, the watercraft 31 is very sporting in nature and frequently is may become capsized or may lead to extreme positions. This is facilitated by the high positioning of the tandem straddle seat 49 for the operator so that he can easily lean the watercraft if he desires. Water may enter the foot areas and drain openings 93 are provided so that this water can be conveniently drained from the foot area. However, there is also some danger that water could flow to the exhaust ports of the engine even considering the embodiment of the water trap devices 46 and 47. Therefore, the exhaust pipes (now to be described) are disposed in such. a way as to further ensure against such water flow to the engine.

A first exhaust pipe 94 extends from the top of the water trap device 46 on the lefthand side of the watercraft along the lefthand side of the watercraft then swings over into the area above the tunnel 62 and terminates at a discharge end 95 within the tunnel 62 and which is disposed substantially on the longitudinal centerline of the watercraft. Because of this, if the watercraft leans very severely, the chances are that the discharge end 95 will be disposed above the water level and this will reduce the likelihood of water entry.

In a similar manner, a second exhaust pipe 96 extends from the water trap device 47 across the front of the engine 35 and along the side of the watercraft parallel to the exhaust pipe 94. This exhaust pipe then terminates in a discharge end 97 that faces the discharge end 95 of the exhaust pipe 94 and which is also positioned close to the longitudinal centerline of the watercraft. Thus, regardless of which way the watercraft may lean or capsize, the possibility of water entering the discharge ends 95 and 97 of the exhaust pipes 94 and 96 is substantially reduced.

A battery 98 is disposed centrally of the watercraft and beneath the straddle-type seat 49. The battery 98 may be easily accessed for servicing through a removable seat section, as will be described in conjunction with later embodiments, or through a side access plate (not shown).

Figure 3:
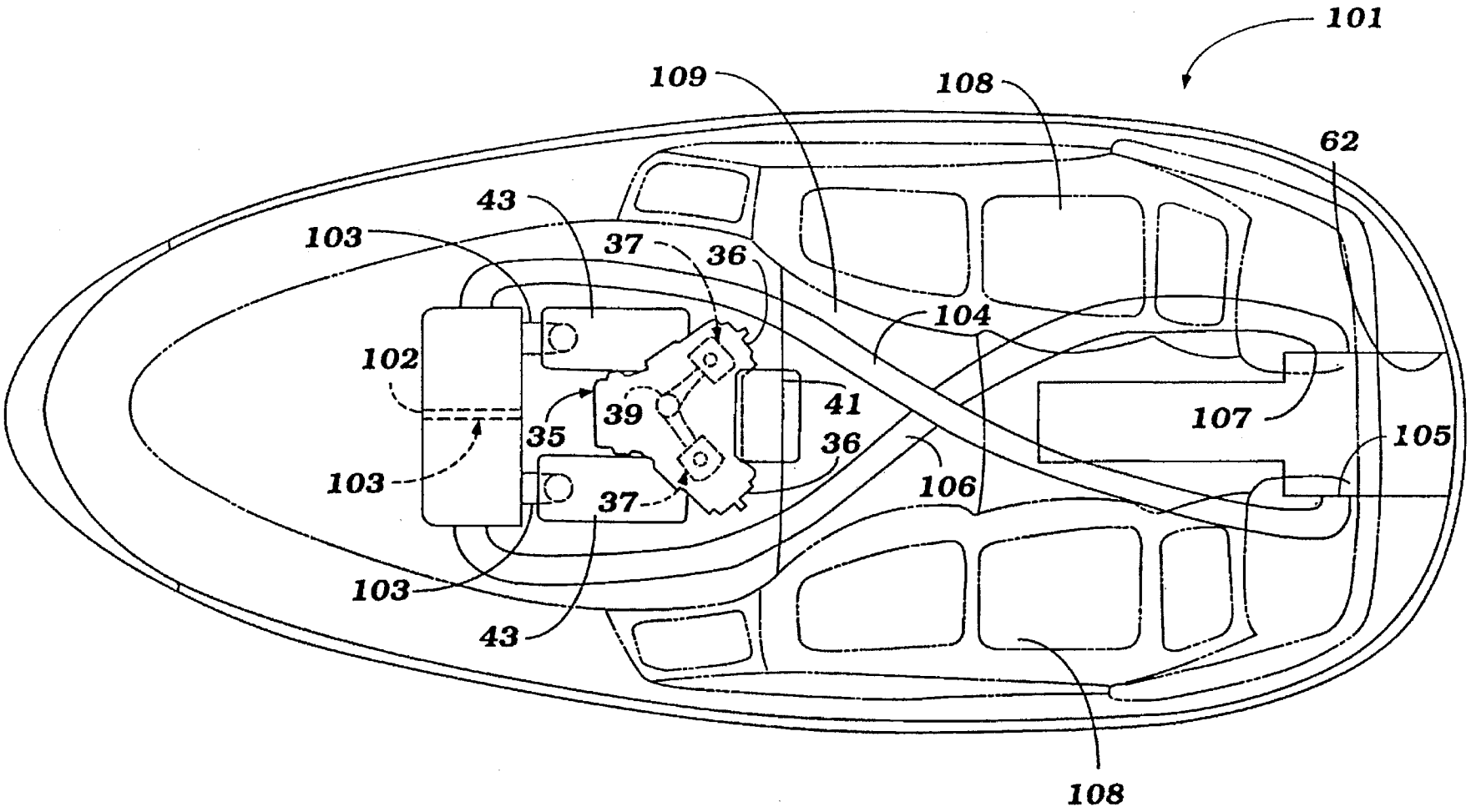
FIG. 3 is a top plan view, in part similar to FIG. 1, with portions broken away and shows a second embodiment of the invention.
Figure 4:
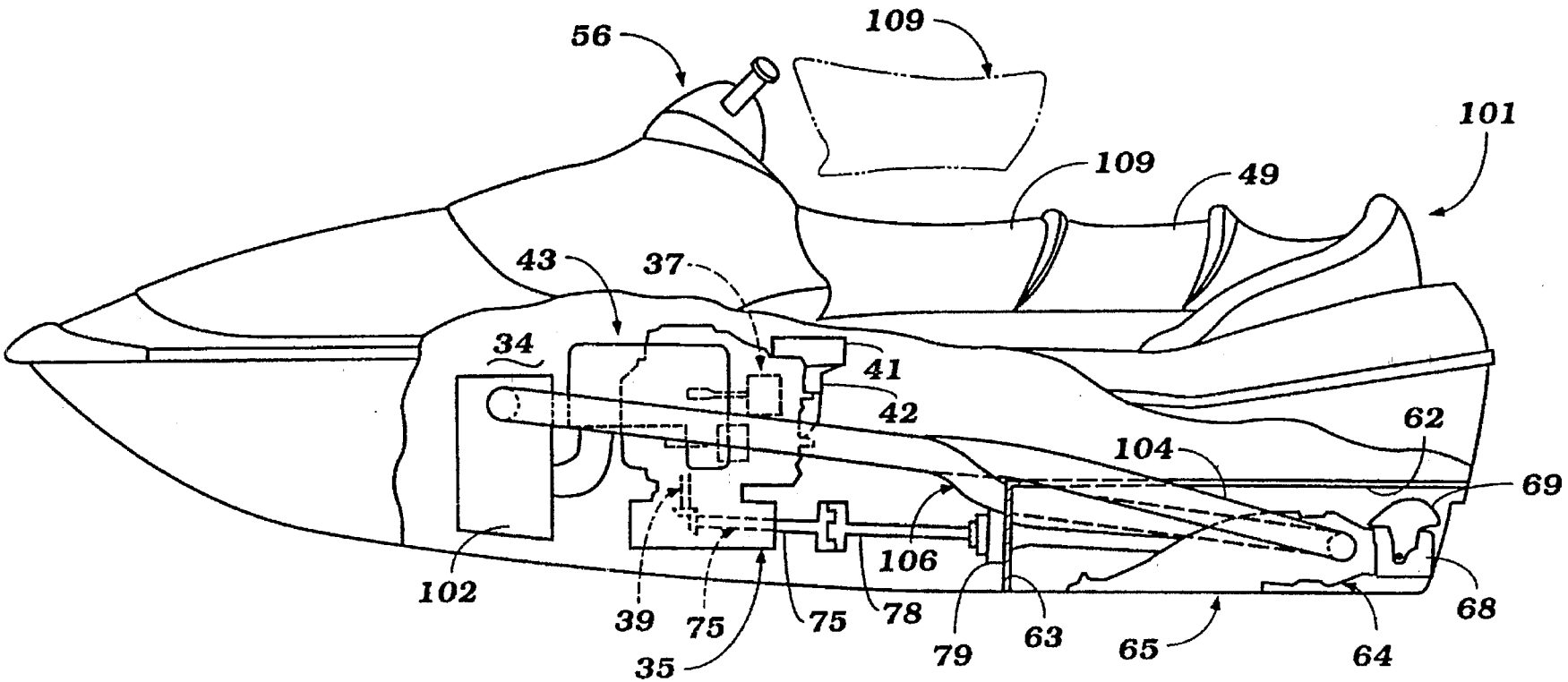
FIG. 4 is a side elevational view of this second embodiment, with a portion broken away and with the removable seat portion being shown in its removed position in phantom.

A watercraft constructed in accordance with a second embodiment of the invention is identified by the reference numeral 101 and is shown in FIGS. 3 and 4. As has been previously noted, many of the components of this embodiment are the same as that previously described and where that is the case, these components have been identified by the same reference numerals. This embodiment differs from the embodiment of FIGS. 1 and 2, primarily in the location of the inlet and exhaust ports of the engine 35, the more rearwardly positioning of the engine 35 and also the depiction of the removable seat section. Therefore, only these components and their differences from the previously described embodiment will be described in detail.

In this embodiment, the engine 35 is positioned so that the intake ports for the crankcase chambers is disposed in the valley between the cylinder banks 36. Therefore, the air inlet device 41 and intake manifold 42 is disposed rearwardly of the engine in this valley. Because the air inlet device is located here, it is possible to shift the engine 35 more rearwardly from the previously described embodiment and hence the double bulkhead and double bearing support for the drive shaft 78 is not required. Only the rear bearing 79 need support the drive shaft 78 in this embodiment.

In a like manner, the exhaust ports are disposed on the outside and forward sides of the cylinder banks 36 and each communicates with a respective expansion chamber device 43 which expansion chamber device 43 delivers the exhaust gases in a forward direction to a single water trap device, indicated generally by the reference numeral 102 through a pair of exhaust conduits 103 which extend in a forward direction. The water trap device 102 extends transversely across the watercraft forwardly of the engine and on the opposite side from the fuel tanks (which are not shown in this embodiment). The interior of the water trap 102 is divided into two compartments by a vertically extending baffle 103.

A first exhaust pipe 104 extends from the side of the water trap device 102 associated with the righthand cylinder bank back along the side of the engine and crosses over to enter the tunnel 62 at the opposite side so that its discharge end 105 is disposed on the opposite side of the longitudinal center plane of the watercraft from the exhaust ports which serve it. In a similar manner, a further exhaust pipe 106 extends from the lefthand side of the water trap device 102 and crosses over to enter the tunnel 62 on the opposite side of this longitudinal plane so a to terminate in a discharge opening 107 which faces the discharge opening 105 of the exhaust pipe 104.

As may be seen in FIG. 3, if the watercraft capsizes so that it will float in the body of water in which the watercraft is operated as shown in this figure, the discharge 107 will be disposed above the water level and hence no water will be likely to enter this discharge end.

Although the discharge end 105 may be disposed below the water level, the exhaust pipe 104 extends upwardly therefrom and hence water is not likely to flow up through the exhaust pipe 104 back to the water trap device 102. Obviously, if the watercraft is capsized in the opposite direction, the discharge end 105 will be above the water level and water must flow upwardly from the submerged discharge end 107 to the exhaust pipe 106 to enter the water trap device 102. Hence, very good water protection is provided for the engine through this exhaust system while it maintains all of the advantages previously described.

In this embodiment, the side seats from the previously described embodiment may be deleted and thus there will be provided elongated foot areas 108 on each side of the straddle-type seat 49. The straddle-type seat 49 is provided with a removable front section 109 which can be easily removed as shown in phantom in FIG. 4 so as to afford access to the engine 35 as may be readily apparent in FIG. 4.

Figure 5:
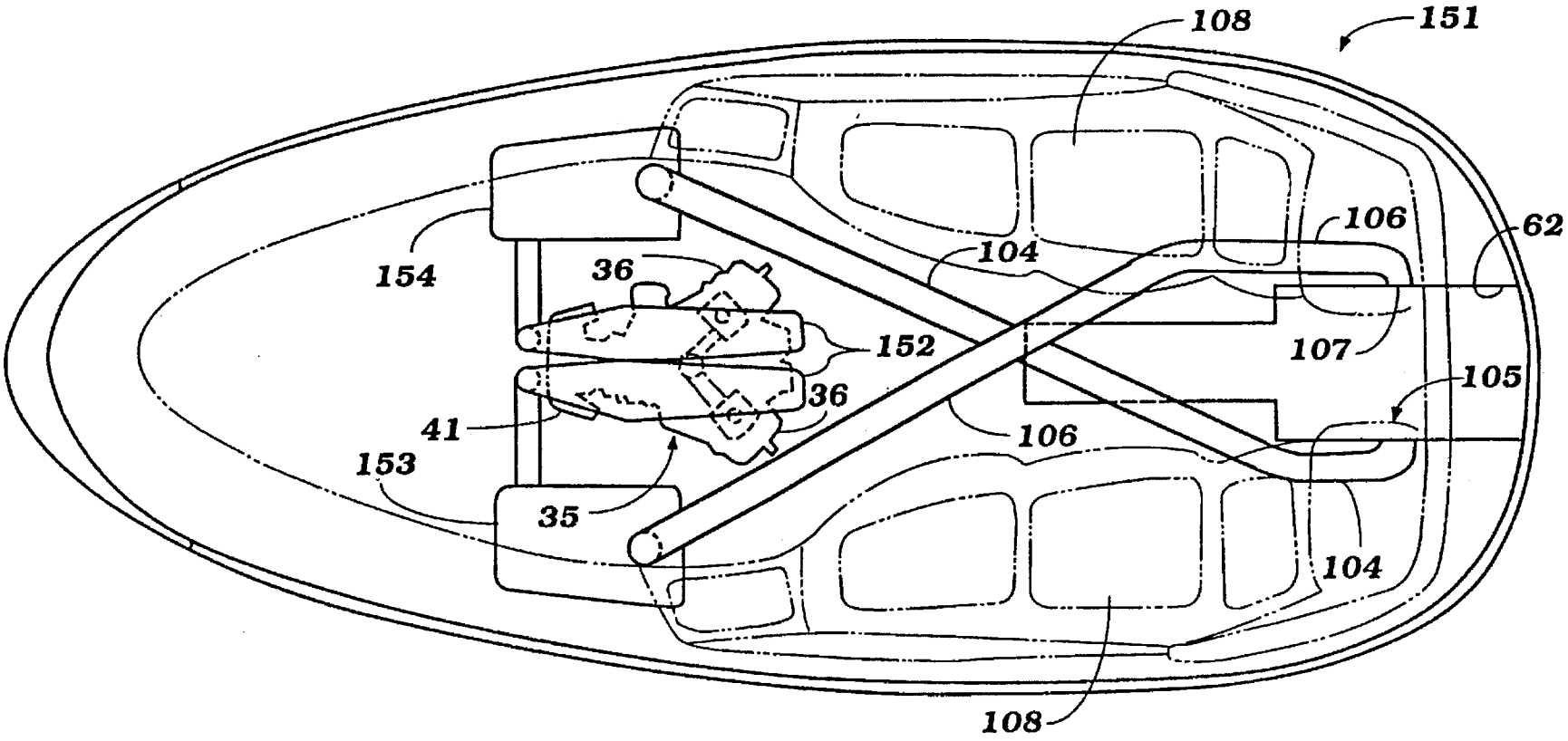
FIG. 5 is a top plan view, in part similar to FIGS. 1 and 3, and shows a third embodiment of the invention, with portions broken away.
Figure 6:
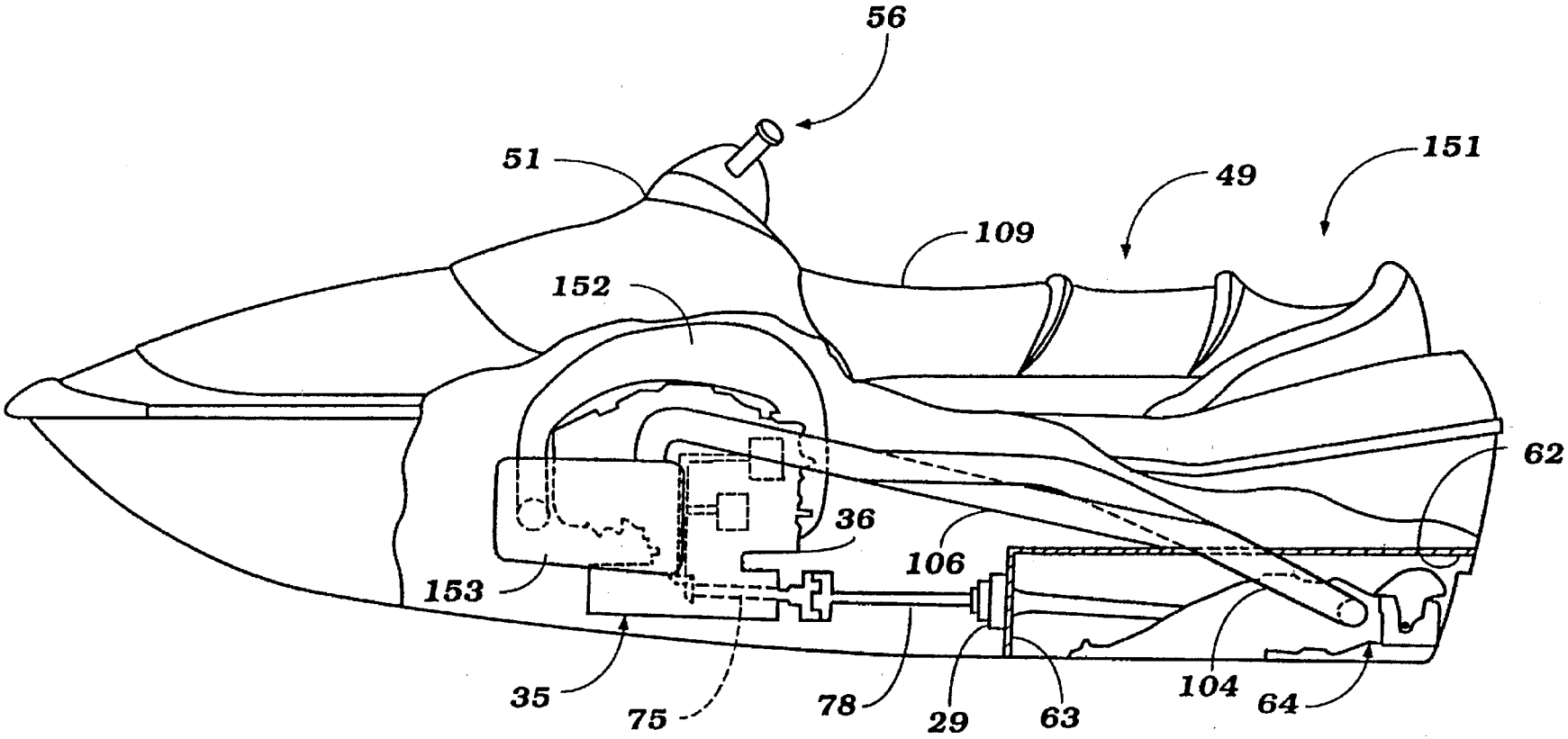
FIG. 6 is a side elevational view of this third embodiment, with a portion broken away.

A watercraft constructed in accordance with a third embodiment of the invention is identified generally by the reference numeral 151 in FIGS. 5 and 6. This embodiment maintains some of the features of the embodiment of FIGS. 1 and 2 in that the engine 35 has its induction and exhaust system disposed as in accordance with that embodiment but also utilizes a crossover type of exhaust arrangement as shown in the embodiment of FIGS. 3 and 4. In this embodiment, however, the water trap devices, while still positioned forwardly, are moved somewhat in a rearward direction from those of the previously described embodiments and this permits substantially all of the mass of the engine and its forwardly positioned auxiliaries to be positioned beneath the control area 51.

In this embodiment, an expansion chamber device 152 extends from the exhaust ports of each cylinder bank 36 in the valley between the cylinder banks over the top of the engine 35 and forwardly to communicate with a respective water trap device 153 or 154. The water trap device 153 communicates with the exhaust pipe 106 which has its discharge end 107 in the tunnel 62 and which crosses over to the opposite side of the longitudinal plane. The water trap device 154 communicates with the exhaust pipe 104 which also cross over and has its discharge end 105 facing the discharge end 107 within the tunnel 62. The water trap devices 153 and 154 are moved rearwardly within the hull and engine compartment 34 but are still positioned forwardly of the exhaust ports of the engine and on the opposite side from these exhaust ports from the fuel tanks, which are located as with the previously described embodiments at the rear side areas of the straddle-type seat 49. Also, since the engine 35 is positioned beneath the control mast 56, the expansion chamber 152 may easily pass over the top of the engine 35 with sufficient clearance.

Figure 7:
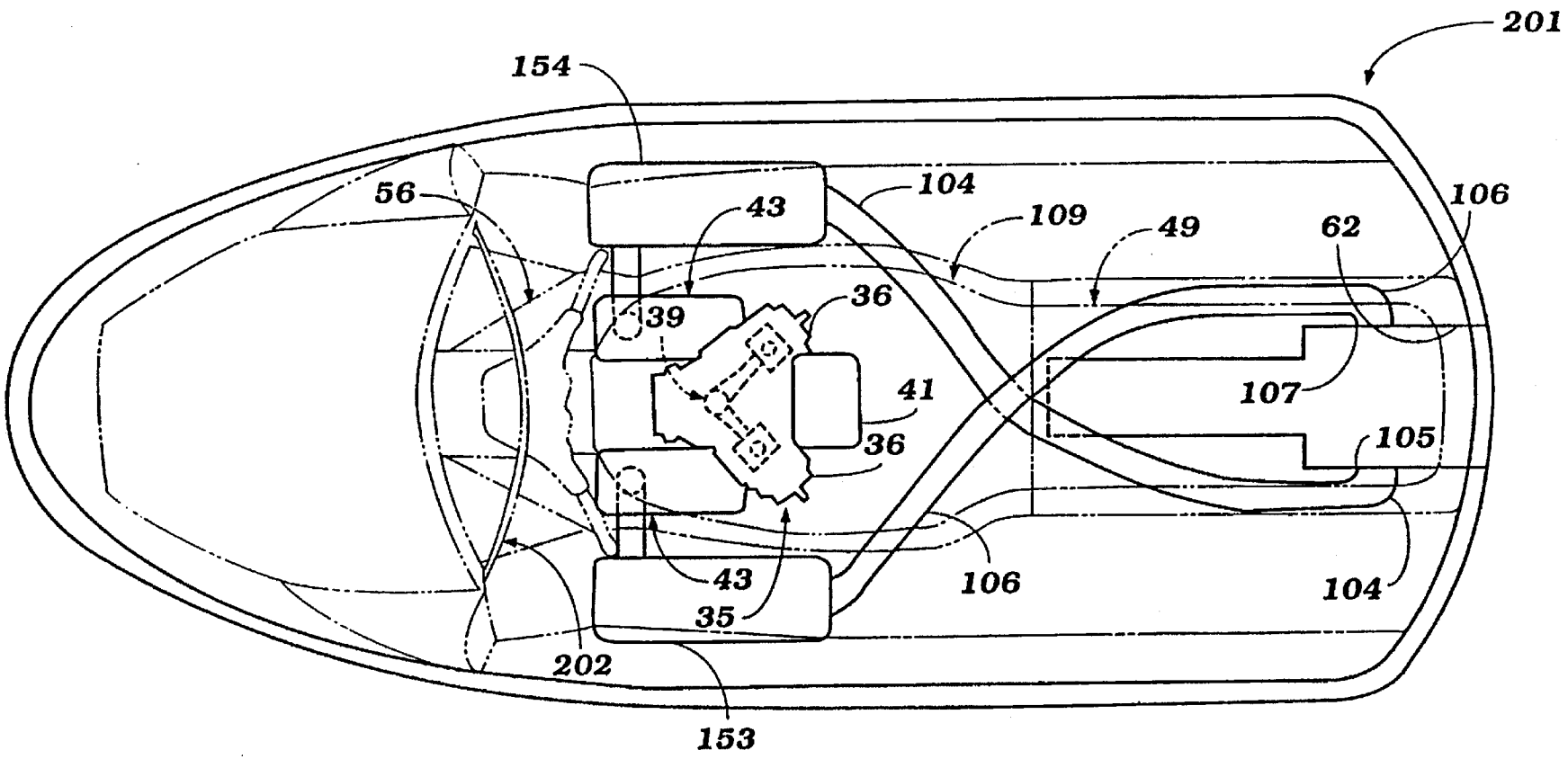
FIG. 7 is a top plan view, in part similar to FIGS. 1, 3, and 5, and shows a fourth embodiment of the invention, with portions broken away.
Figure 8:
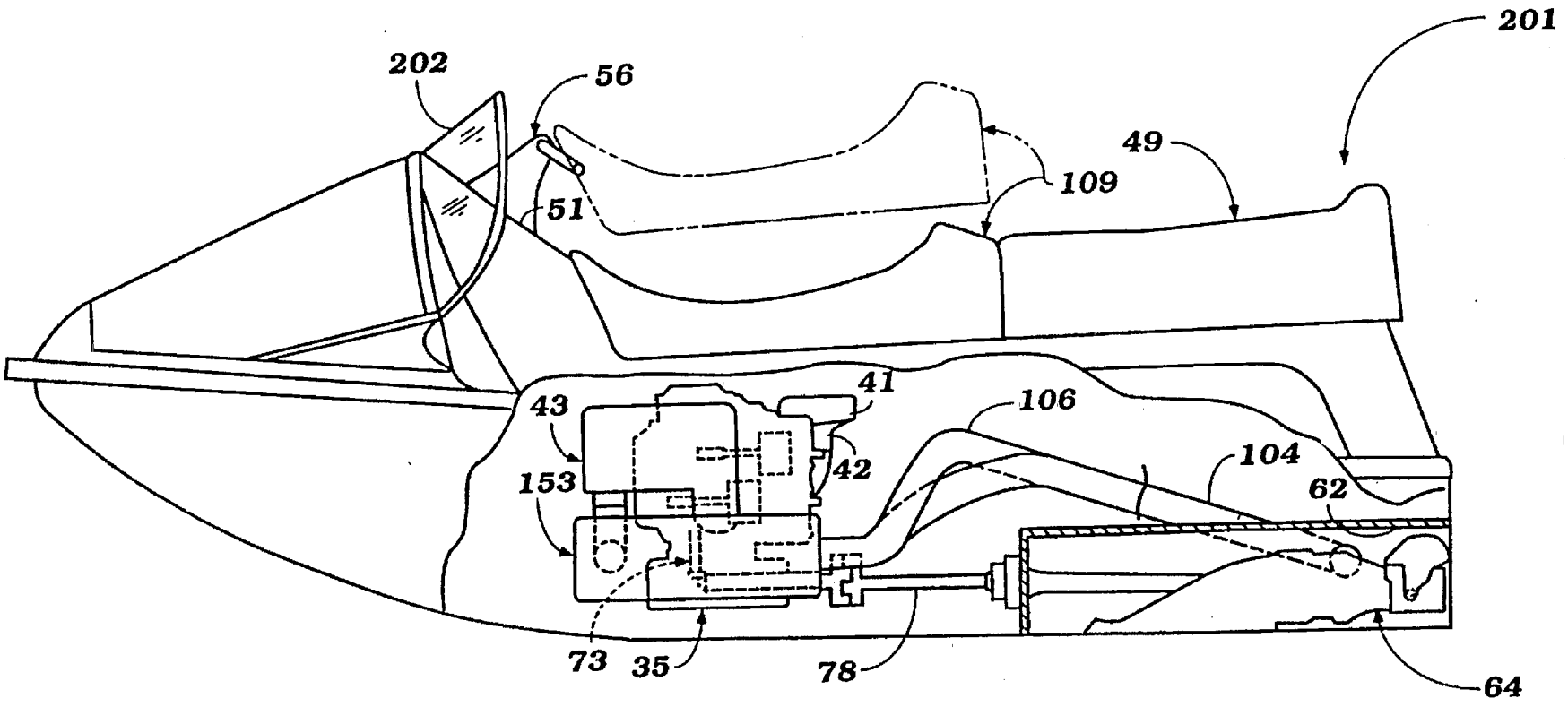
FIG. 8 is a side elevational view of this fourth embodiment of the invention, with portions broken away and with the removable seat portion being shown removed in phantom lines.

A watercraft constructed in accordance with a fourth embodiment of the invention is shown in FIGS. 7 and 8 and is identified generally by the reference numeral 201. In all of the embodiments thus far described, the engine 35 has been disposed generally forwardly of the straddle-type seat 49 and beneath the control mast 56. In this embodiment, the engine 35 is moved rearwardly beneath the forward removable seat portion 109. In addition, this embodiment shows how the exhaust system and separate water trap devices that are disposed on the sides of the engine as shown in FIGS. 5 and 6 may be employed with an engine having the induction system in the valley between the cylinder banks 36 and the exhaust ports on the outside of the cylinder bank as shown in the embodiment of FIGS. 3 and 4. Because of these similarities, it is believed that the use of the corresponding reference numerals from the foregoing figures in this generally brief description will permit those skilled in the art to understand the construction of this embodiment.

It should be noted that in this construction, the water trap devices 153 and 154 may be positioned beneath the foot areas while the expansion chambers 43 and engine 35 are disposed beneath the removable seat portion 109. The rearward splaying of the cylinder banks 39 permits the narrowest portion of the engine to be disposed in an area where the rider or operator's legs will be located with the wider portion of the engine being disposed rearwardly. Although this necessitates some widening of the removable seat portion 109 at its rear portion, it does not adversely affect the seating posture of either the rider or operator or any riders who may be seated in tandem fashion behind the rider or operator. In this embodiment, a windshield 202 is provided forwardly of the steering mast for rider protection.

Because of the vertical orientation of the engine 35 and its disposition beneath the removable seat portion 109, it should be readily apparent that the entire engine assembly 35 may be easily removed from the watercraft by removing the seat portion 109 and lifting the engine 35 vertically upwardly. This affords ease of access.

Figure 9:
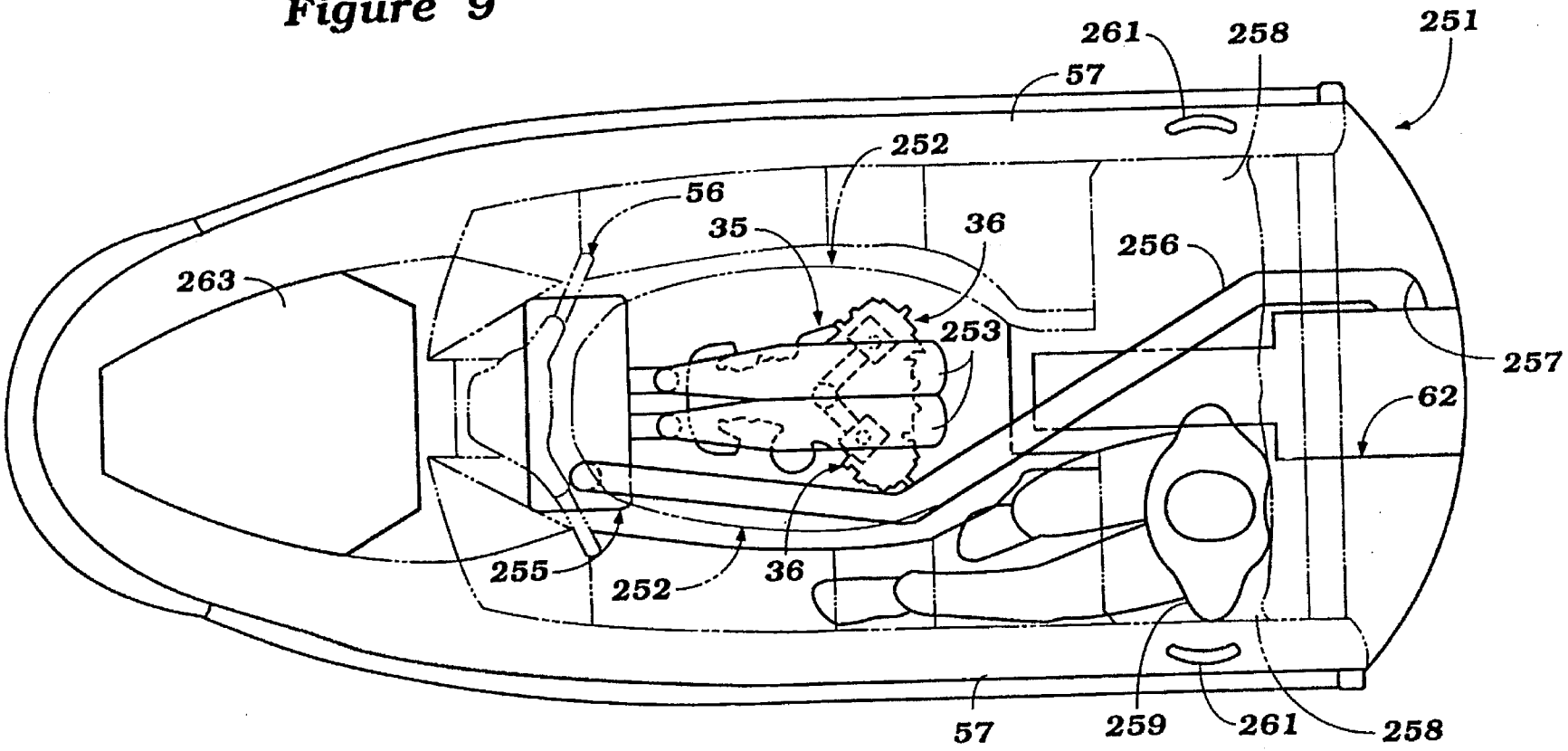
FIG. 9 is a top plan view, in part similar to FIGS. 1, 3, 5, and 7, of a fifth embodiment of the invention, with portions broken away and other portions shown in phantom.
Figure 10:
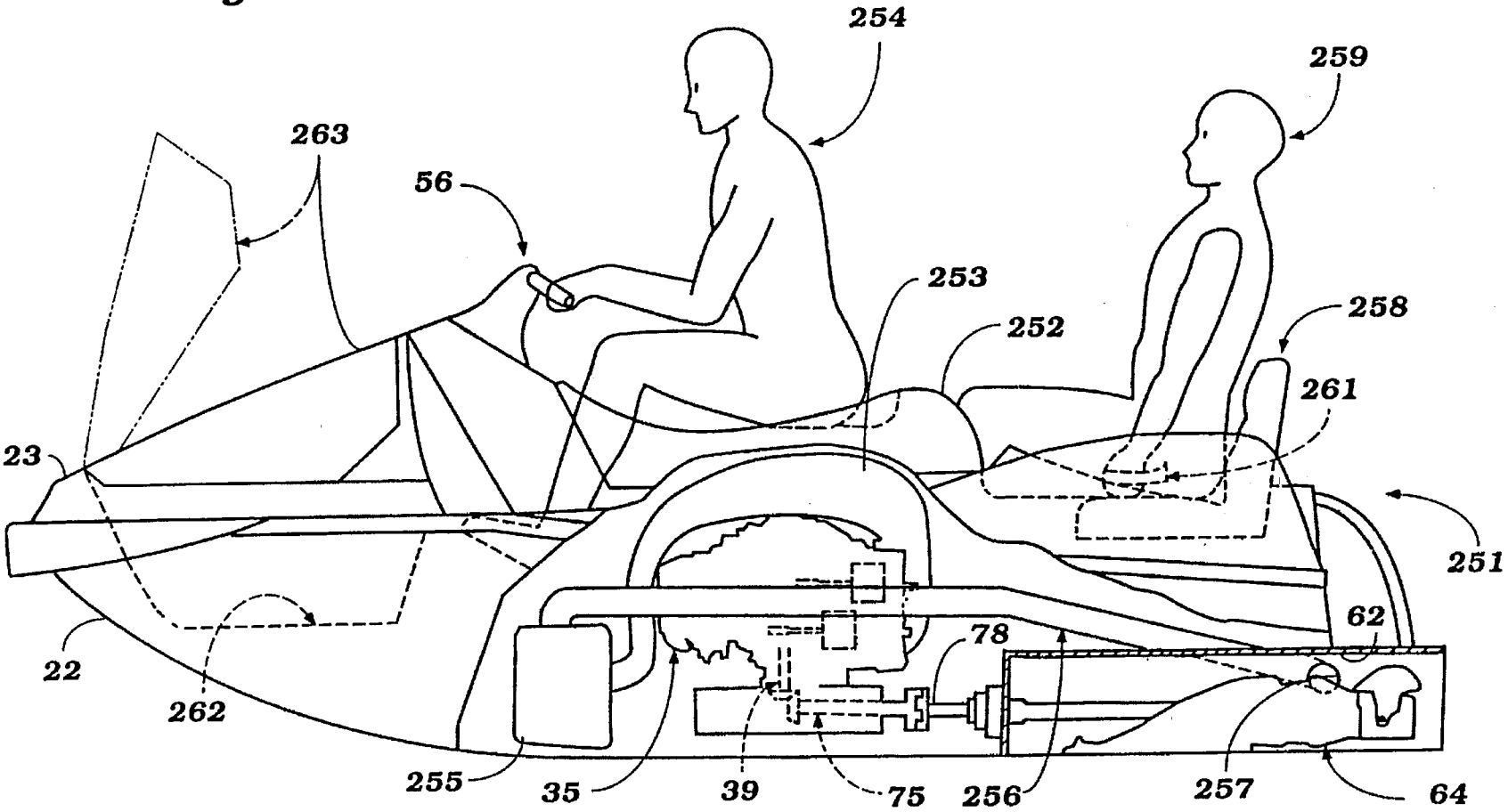
FIG. 10 is a side elevational view of this embodiment, with portions broken away and with the front hatch cover being shown in its closed position in solid lines and in its open position in phantom lines.

FIGS. 9 and 10 show another embodiment of the invention which is identified generally by the reference numeral 251 and which employs an underseat placement for the engine and water trap device like the embodiment of FIGS. 7 and 8. This embodiment also shows a slightly different seating arrangement, more like that of FIGS. 1 and 2, and shows a slightly different exhaust system. Also, this embodiment illustrates how the forward area of the hull may be provided with an additional storage area. As previously noted, components of this embodiment which are the same or substantially the same as the previously described embodiments have been identified by the same reference numerals and will be described again only insofar as to understand the construction and operation of this embodiment.

In this embodiment, the engine 35 is disposed in an engine compartment formed beneath a single straddle type rider or operator seat 252 which is removable, as with the removable seat portion 109 of the earlier described embodiments so as to access the engine and engine compartment. In this embodiment, like all of the embodiments as thus far described, the cylinder banks 36 diverge rearwardly and in this embodiment, the exhaust ports are disposed in the valley between the cylinder banks. Thus, there are a pair of expansion chamber devices 253 that convey the exhaust gases from the exhaust ports of the cylinder banks 36 forwardly and above the engine 35. This is possible because of the positioning of the engine under the operator's seat 252 which is higher than the remaining seats, as will be described, so that a rider or operator shown in FIG. 10 and identified by the reference numeral 254 will be positioned so as to facilitate leaning of the watercraft for maneuvering.

The expansion chamber devices 253 communicate with a common water trap device 255 that is positioned transversely across the forward portion of the area beneath the rider's seat 252. In this embodiment, a single exhaust pipe 256 conveys the exhaust gases back from one side of the water trap device 255 to the tunnel 62 on the opposite side of the watercraft wherein there is a discharge end 257 provided. Thus, if the watercraft is capsized in the direction shown in FIG. 9, the exhaust pipe outlet 257 will be disposed,above the water level. If capsized in the opposite direction, the exhaust gases must flow from the submerged outlet 257 in an uphill direction and thus, assurance is provided regardless of the degree of capsizing against the water entering the water trap device 255 or flowing back to the exhaust port of the engine.

In this embodiment, there are provided a pair of side seats 258, each of which has a back rest and which are disposed on opposite sides of and to the rear of the straddle type operator seat 252. This will accommodate a pair of riders 259 seated in side-by-side fashion so as to maintain stability. Hand grips 261 are provided on the gunnels 57 so as to permit the riders to stabilize themselves if desired.

Because of the rear placement of the engine 35 and the fact that the cylinder banks 36 diverge rearwardly, the front seat 252 can be maintained relatively narrow and there will be provided a large area forwardly of the hull portion 22 and beneath the deck portion 23 that can afford a storage area, indicated generally by the reference numeral 262. This storage area is accessible through a pivoted hatch cover 263 of the deck portion 23 forwardly of the mast 56.

It should be noted that this arrangement permits the passengers 259 to sit lower than the operator rider 254 as with certain of the previously described embodiments. Also, because the front seat 252 does not extend as far rearwardly, there is more room for the legs of the rider 259 on the rear seat 258.

Figure 11:
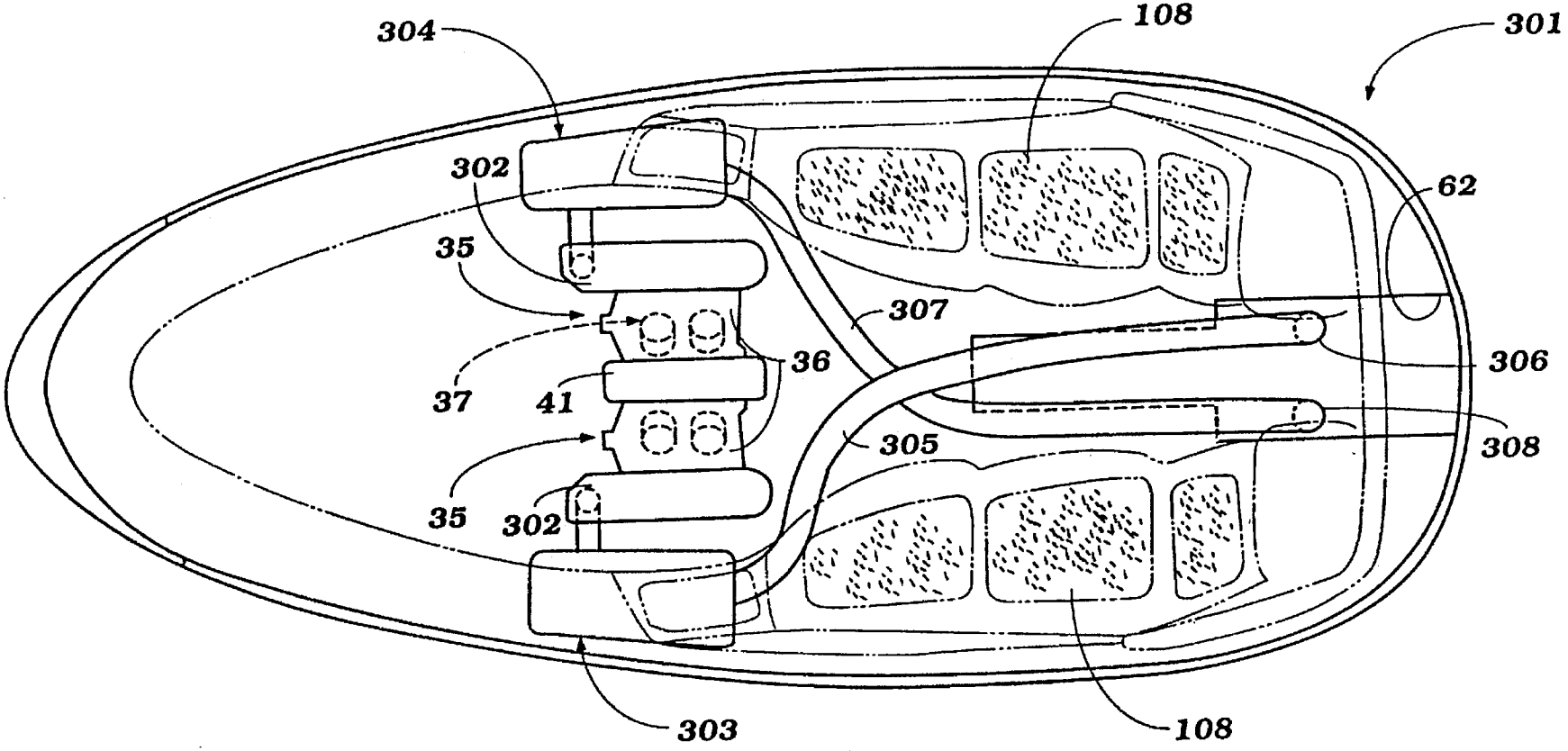
FIG. 11 is a top plan view, in part similar to FIGS. 1, 3, 5, 7, and 9, of a sixth embodiment of the invention, with portions broken away and other portions shown in phantom.
Figure 12:
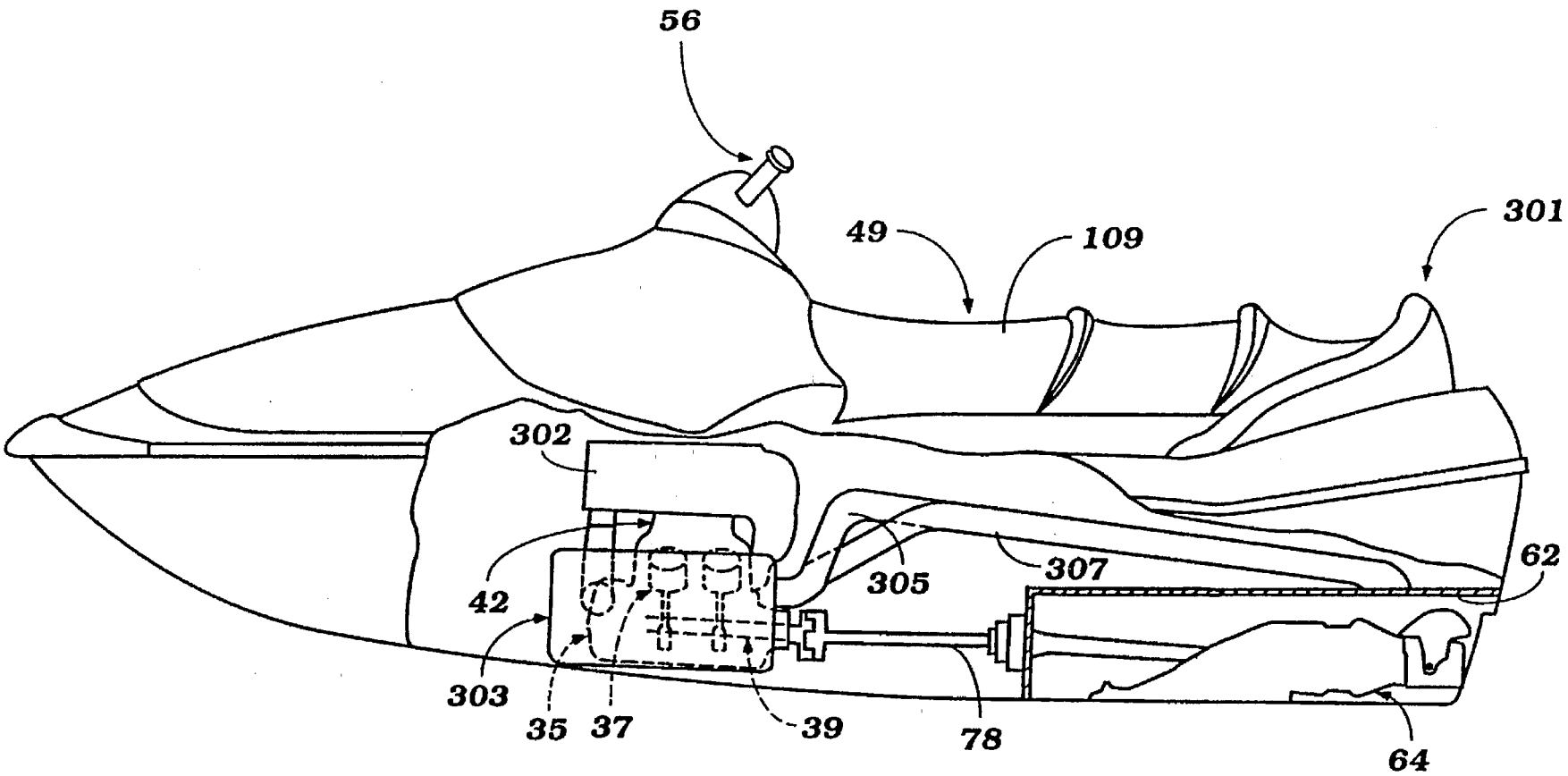
FIG. 12 is a side elevational view of the sixth embodiment, with portions broken away.

In all of the embodiments as thus far described, the engine 35 has been disposed so that its crankshaft 39 rotates about a vertically extending axis. FIGS. 11 and 12 show a sixth embodiment of the invention in a watercraft indicated generally by the reference numeral 301 wherein the engine 35 is disposed so that its crankshaft 39 rotates about a longitudinally extending horizontal axis. The engine 35 is, like the embodiments of FIGS. 1–6, disposed so that it is positioned beneath the steering mast 56 and forwardly Of the rider's seat, which, in this embodiment, has a construction as that of the embodiment of FIGS. 3 and 4 and thus, is identified by the same reference numerals 49 with the removable section 109 for access. The basic construction of the engine is the same as those previously described and hence, the description of the pistons 37 and cylinder banks 36 will not be described again. In this embodiment, the induction system is disposed in the valley between the cylinder banks like the construction of FIGS. 3 and 4 and the components associated with it have been identified by the same reference numerals.

The exhaust ports of the engine are disposed on the outside of the valley and a pair of expansion chamber devices 302 receive the exhaust gases from each cylinder bank 36. The expansion chambers 302 then communicate with respective water traps 303 and 304 which are generally aligned with the engine 36 and disposed transversely outwardly of it. Because of the forward placement of the engine 35, this position of the water traps 303 and 304 is possible because they are forward of the foot areas.

This system employs a cross-over type of exhaust system as shown in FIGS. 3 and 4 so as to achieve the water protection features. That is, a first exhaust pipe 305 extends from an upper surface of the water trap 303 and transversely across the watercraft so as to terminate in a discharge end 306 that communicates with the tunnel 62. The end 306 is disposed on the side of the longitudinally extending plane opposite to those of the exhaust ports of the cylinder bank which it serves. In this embodiment, the exhaust pipe opening 306 faces downwardly.

In a similar manner, an exhaust pipe 307 extends from an upper portion of the water trap device 304 transversely across the watercraft and terminates in a downwardly facing opening 308 that is disposed on the same side as the longitudinal plane as the water trap device 303 and opposite that of the water trap device 304. Hence, this embodiment also provides water protection as previously described. Also, since the exhaust pipes 305 and 307 cross over forwardly of the floor area 108 and beneath the seat 49, they will not encroach on the foot area 108.

Figure 13:
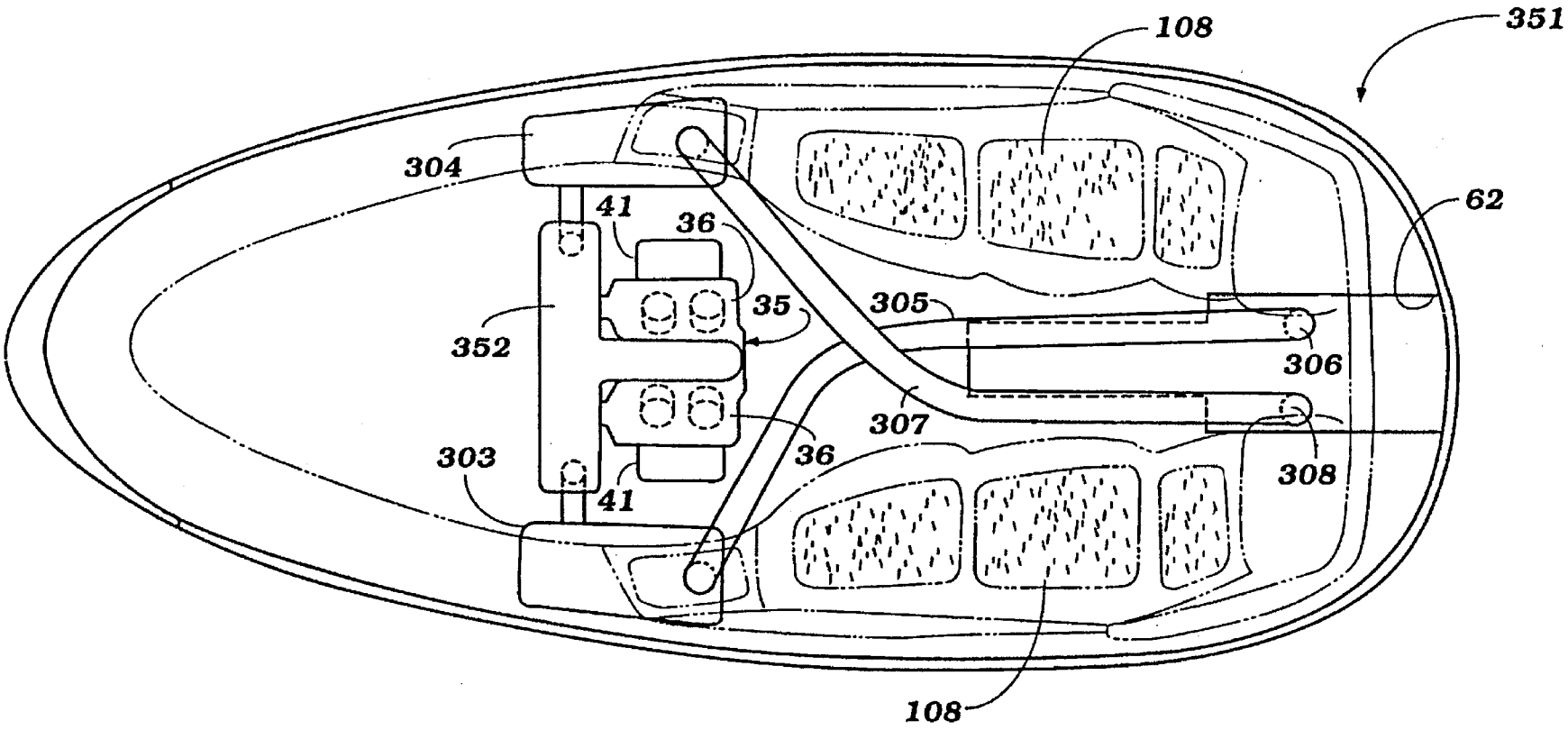
FIG. 13 is a top plan view, in part similar to FIGS. 1, 3, 5, 7, 9, and 11, and shows a seventh embodiment of the invention, with portions broken away and other portions shown in phantom.
Figure 14:
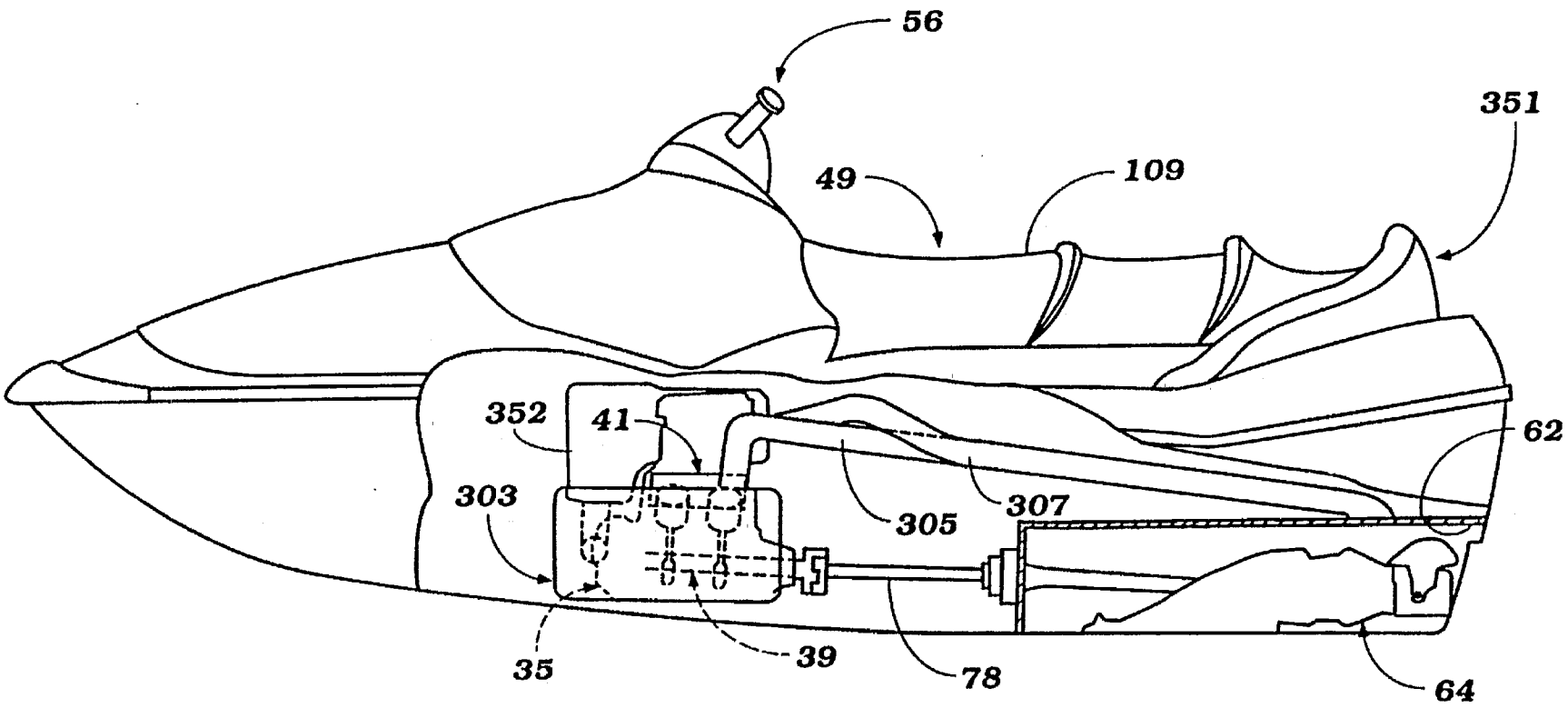
FIG. 14 is a side elevational view of this seventh embodiment, with portions broken away and shown in sections.

A watercraft constructed in accordance with a seventh embodiment of the invention is identified generally by the reference numeral 351 and is shown in FIGS. 13 and This embodiment incorporates an engine 35 that has its output shaft rotatable about a horizontally disposed axis and is generally the same as the embodiment of FIGS. 11 and 12. However, a slightly different type of exhaust system is employed with this embodiment and that exhaust system includes a single expansion chamber device 352 that receives the exhaust gases from the exhaust ports of each cylinder bank in view of the fact that in this embodiment, the exhaust ports are disposed in the valley between the cylinder banks 36. The single expansion chamber device 352 delivers the exhaust gases to respective water traps 303 and 304 positioned on opposite sides of the engine 35 as with the previously described embodiment of FIGS. 11 and 12. Exhaust gases are delivered to the tunnel area 62 from these water trap devices 303 and 304 by exhaust pipes 305 and 307 as with the previously described embodiment. In this embodiment, the exhaust pipe 307 passes over the exhaust pipe 305 but in all other regard, the exhaust system is the same as the previously described embodiment and, for that reason, further description of this embodiment is not believed to be necessary. It should be noted, however, that there is a separate air intake device 41 for each cylinder bank and these are disposed outside of the valley between the cylinder banks 36 as clearly shown in the figure.

Figure 15:
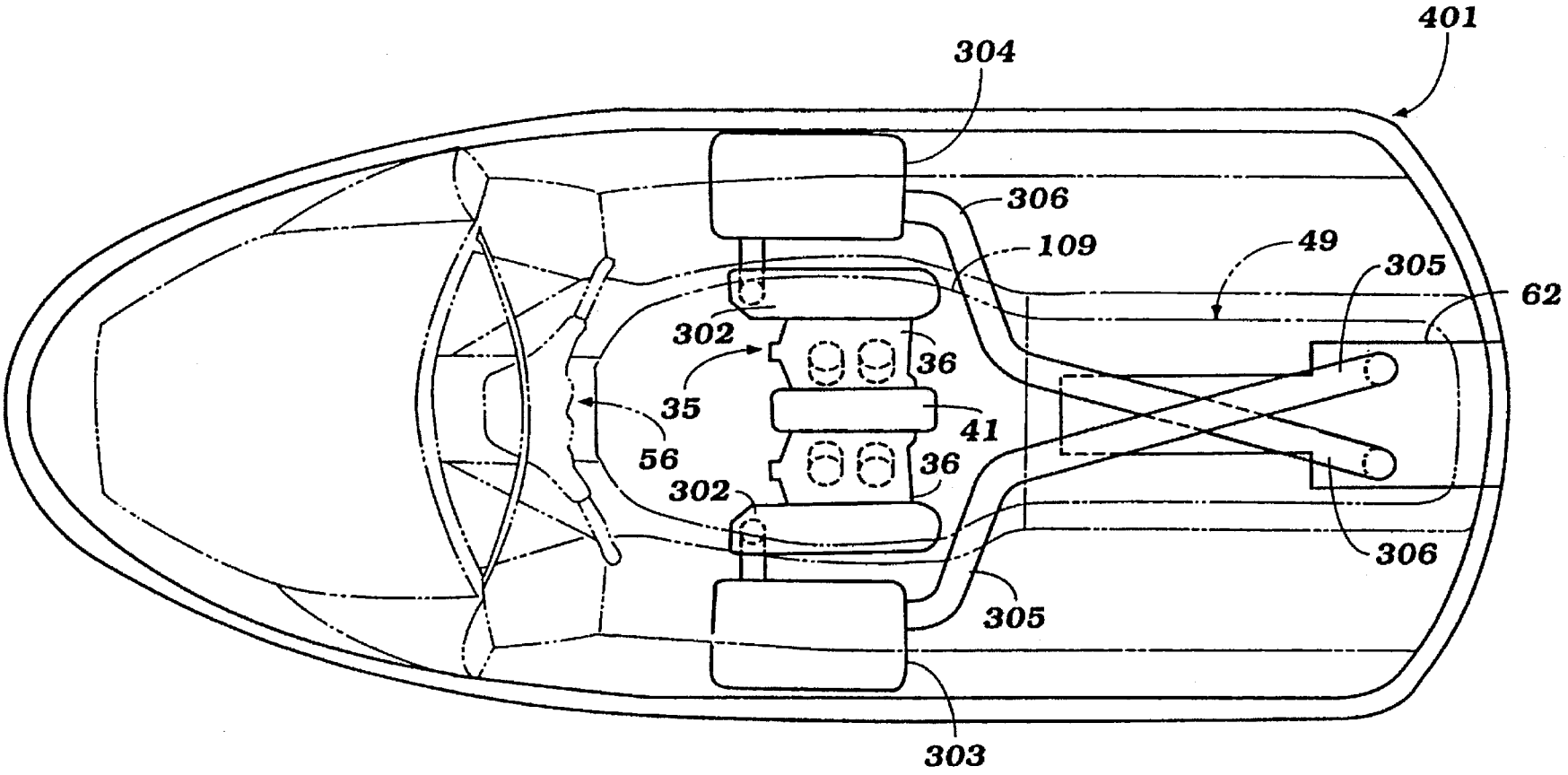
FIG. 15 is a top plan view, in part similar to FIGS. 1, 3, 5, 7, 9, 11, and 13, with portions broken away and other portions shown in phantom, of an eighth embodiment of the invention.
Figure 16:
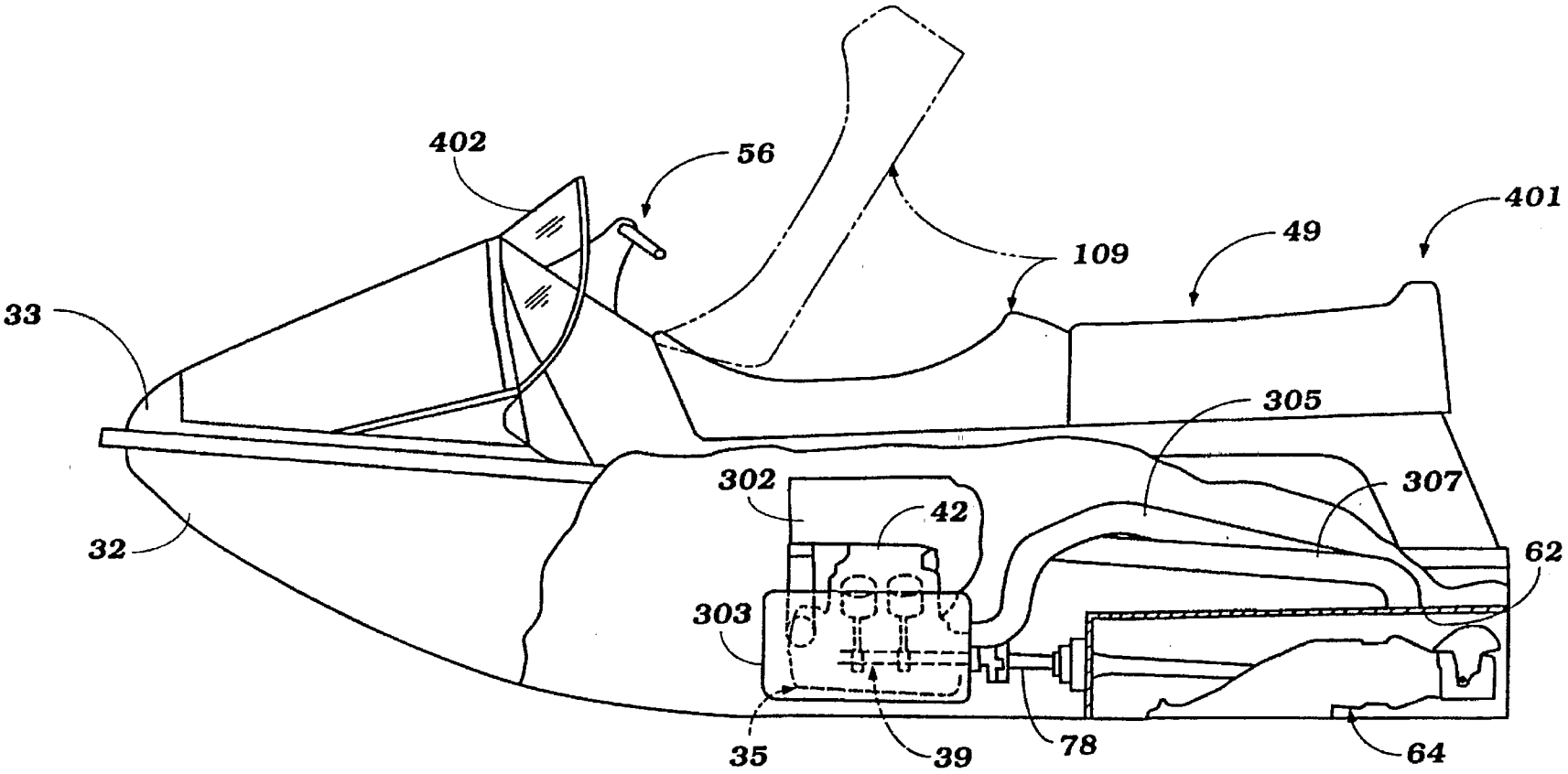
FIG. 16 is a side elevational view of this eighth embodiment, with portions broken away and with the front seat portion shown in its normal position in solid lines and in its opened position in phantom lines.

A watercraft constructed in accordance with an eighth embodiment of the invention is shown in FIGS. 15 and 16 and is identified generally by the reference numeral 401. Like the embodiments of FIGS. 11, 12, 13 and 14, this embodiment employs an engine 35 which has its crankshaft 39 rotatable about a horizontally extending axis that is longitudinally disposed in the watercraft 401. In this embodiment, however, the engine 35 is moved rearwardly so as to permit the use of a relatively short drive shaft 78 and to position the engine 35 under the removable seat portion 109. In this embodiment, however, the seat portion 109, rather than being totally removable, is pivotally connected at its forward end to the deck portion 33 for movement between a normal riding position as shown in solid lines in FIG. 16 and an open service position as shown in phantom lines in this figure. Because of the more rearward placement of the engine and water trap devices 303 and 304, the exhaust pipes 305 and 307 cross over each other over the tunnel area 62 rather than forwardly of it.

Because of the more rearward placement, it is also possible to use a windshield 402 forwardly of the control mast 56. In all other regards, this embodiment is the same as that of the embodiment of FIGS. 11 and 12 and, for that reason, further description of this embodiment is not believed to be necessary to permit those skilled in the art to understand the construction and operation of this embodiment.

Figure 17:
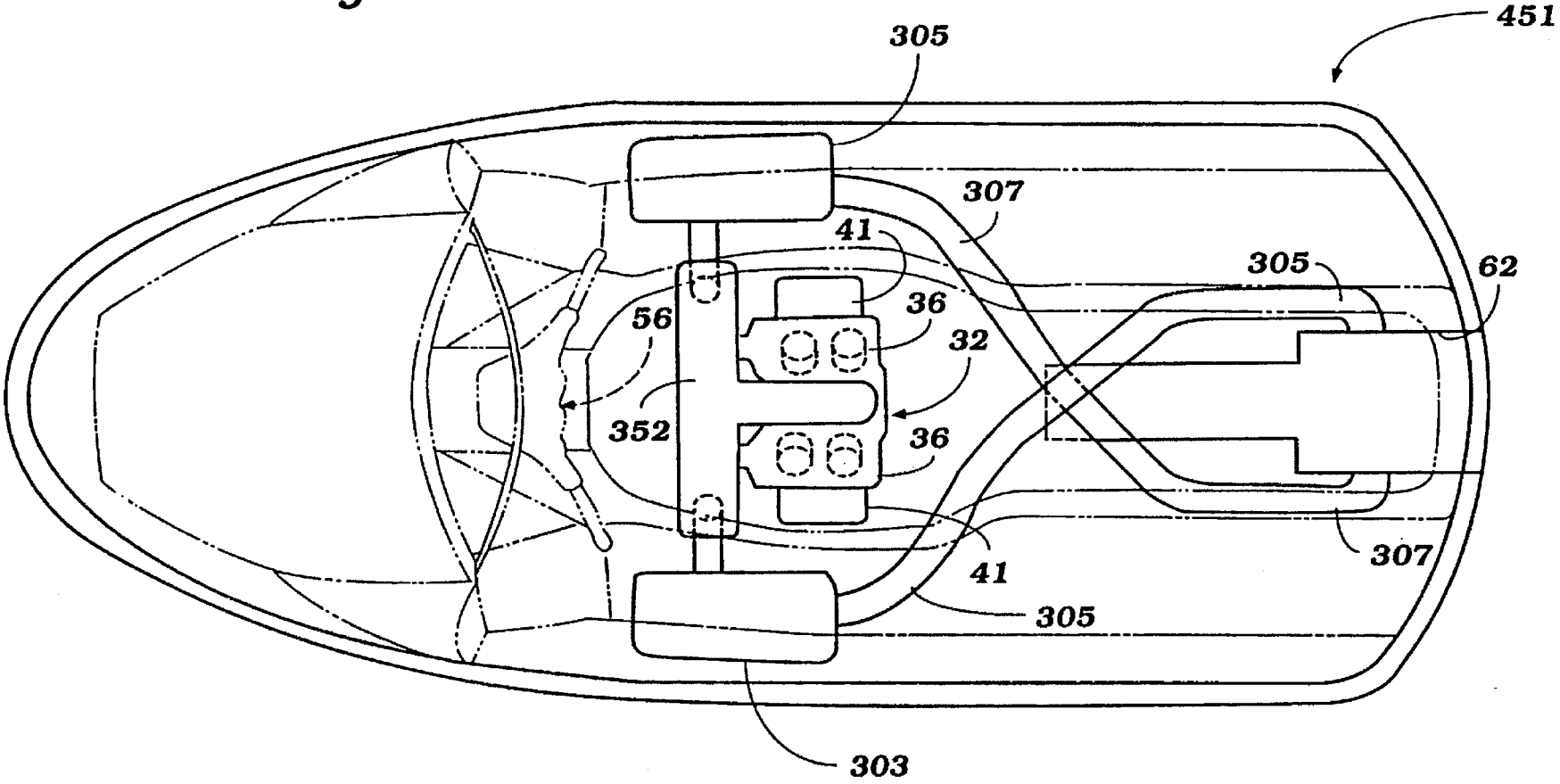
FIG. 17 is a top plan view, in part similar to FIGS. 1, 3, 5, 7, 9, 11, 13, and 15, and shows a ninth embodiment of the invention, with portions broken away and other portions shown in phantom.
Figure 18:
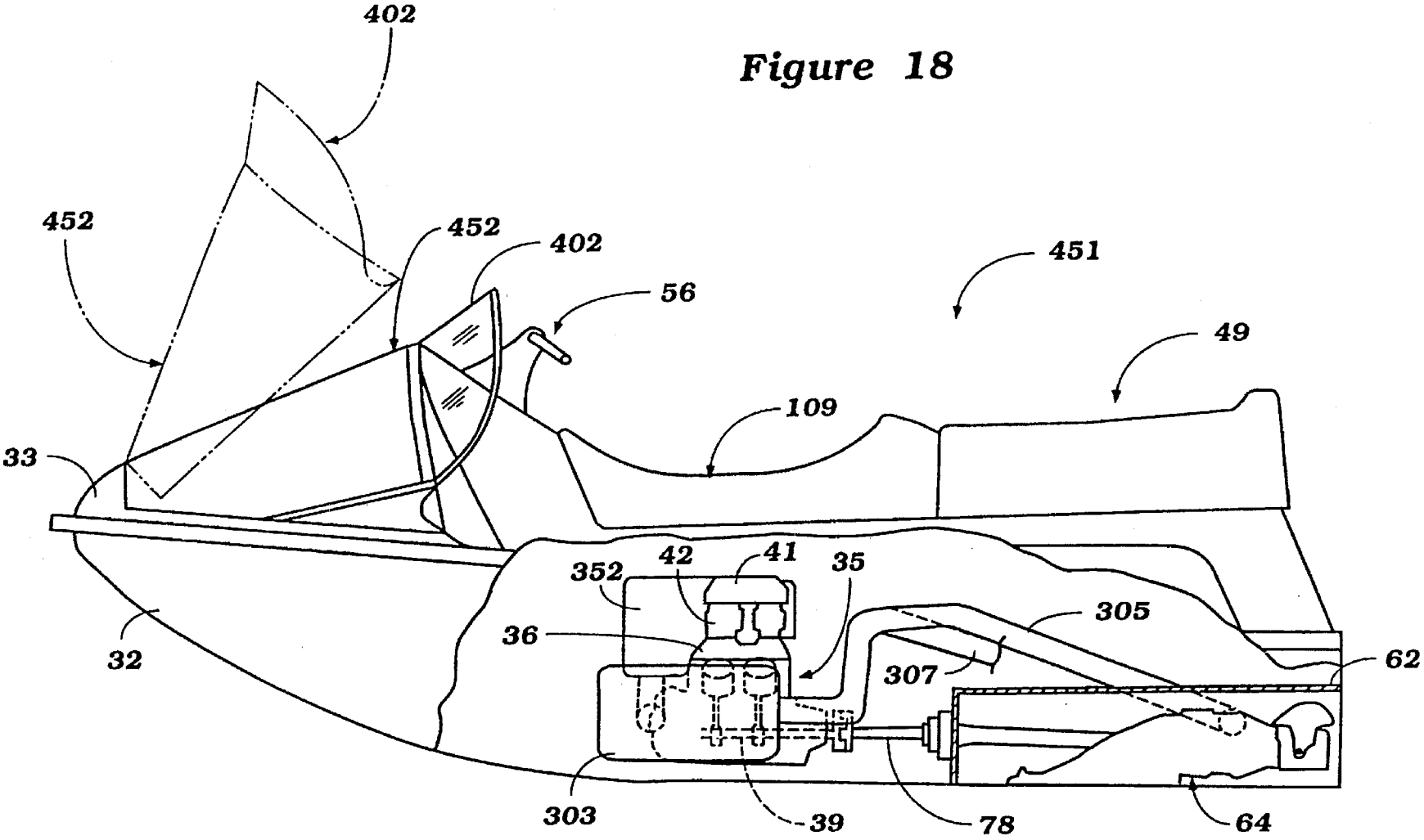
FIG. 18 is a side elevational view of this ninth embodiment, with portions broken away and shown in section and with the front storage compartment cover shown in its closed position in solid lines and its open position in phantom lines.

A watercraft constructed in accordance with a ninth embodiment of the invention identified generally by the reference numeral 451 and is shown in FIGS. 17 and 18. The watercraft 451, like the watercraft 401 of the embodiment of FIGS. 15 and 16, includes an engine 35 having its crankshaft 39 rotatable about a horizontally disposed longitudinally extending axis and which is positioned beneath the front seat portion 109. This embodiment employs an exhaust system of the type shown in FIGS. 13 and 14 wherein the exhaust gases from the exhaust ports disposed in the valley between the cylinder banks 36 flow into a common expansion chamber device 352 and are discharged to respective side-mounted water trap devices 303 and 304 for discharge to the atmosphere through the tunnel 62 by exhaust pipes 305 and 307, respectively. In this embodiment, however, the discharge ends of the exhaust pipes 305 and 307 face each other as shown in FIG. 17.

This embodiment also includes a forwardly disposed storage compartment formed by the hull portion 32 and deck hole portion 32 and deck portion 33. In this embodiment, however, the deck portion 33 has a pivotally supported hatch cover 452 that is pivoted to the remainder of the deck portion about a forwardly extending pivot axis for movement between a closed portion as shown in solid lines in FIG. 18 and in open position as shown in phantom lines. The windshield 402 is carried by this hatch portion.

Figure 19:
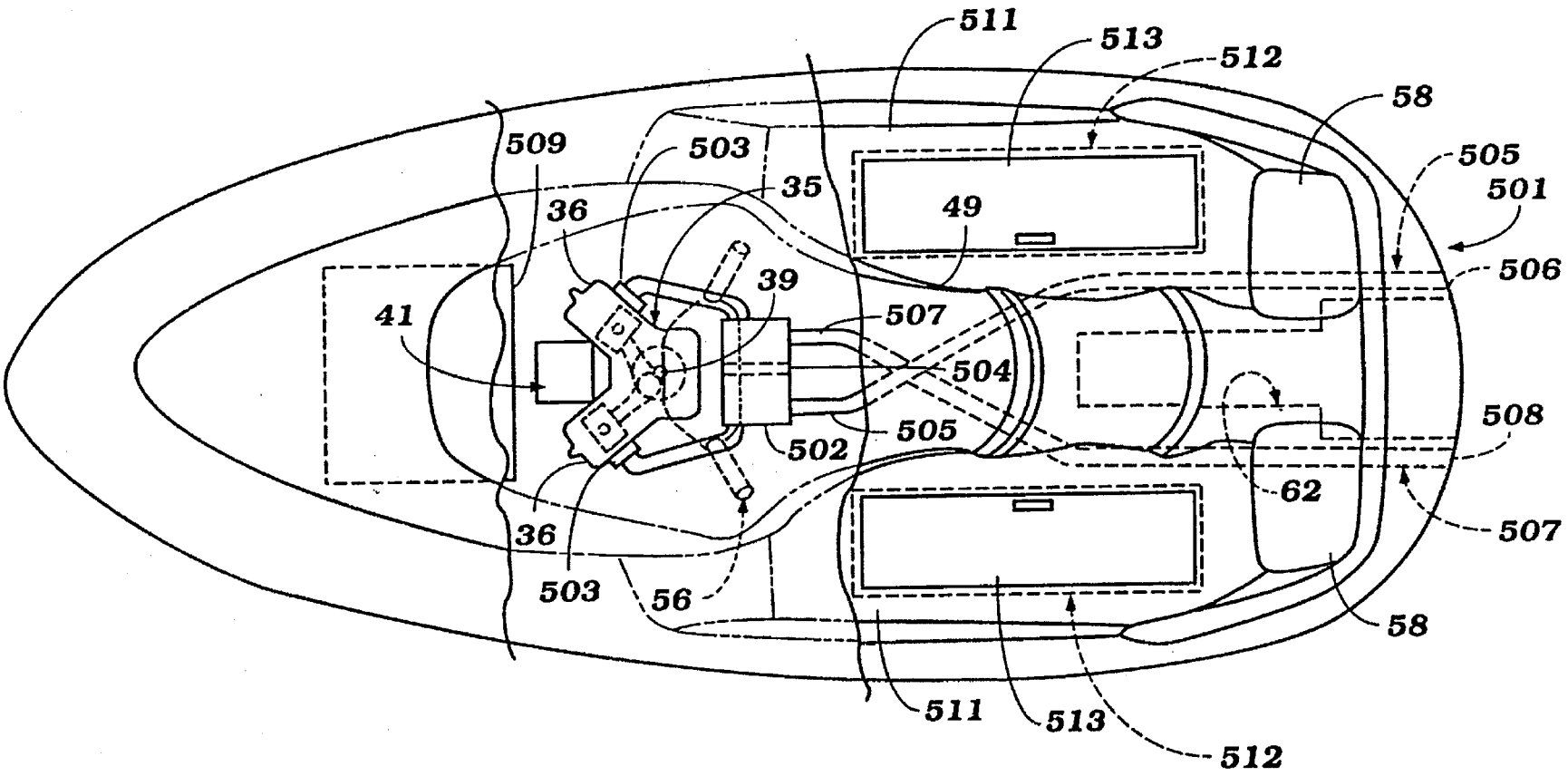
FIG. 19 is a top plan view, in part similar to FIGS. 1, 3, 5, 7, 9, 11, 13, 15, and 17, with portions broken away and other portions shown in phantom, and illustrates a tenth embodiment of the invention.
Figure 20:
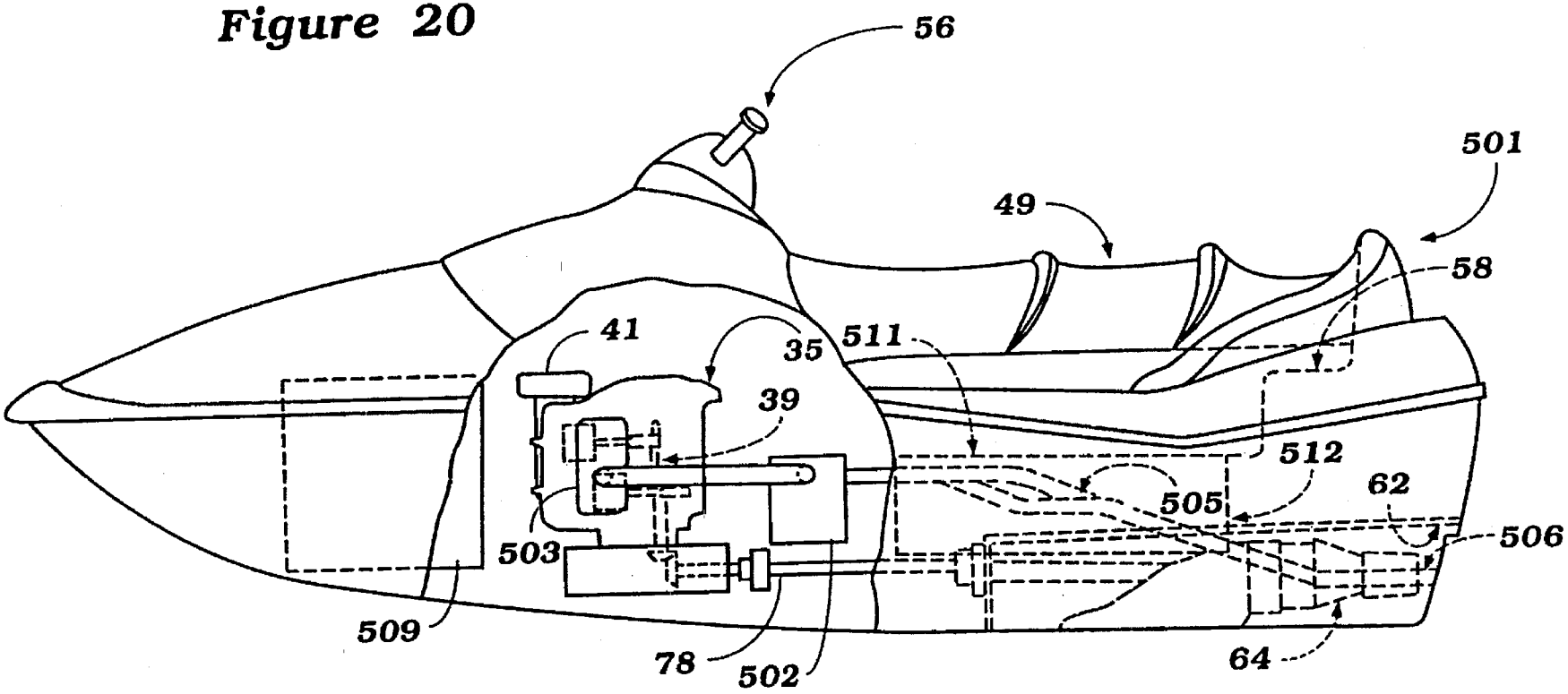
FIG. 20 is a side elevational view of this tenth embodiment of the invention, with a portion broken away.

A watercraft constructed in accordance with a tenth embodiment of the invention is shown in FIGS. 19 and 20 and identified generally by the reference numeral 501. This watercraft employs an engine 35 which like the earlier described embodiments has its crankshaft 39 rotatable about a vertically extending axis. In this embodiment the engine 35 has its intake and exhaust ports configured like that of the embodiment of FIGS. 3 and 4 wherein the induction system is disposed between the cylinder banks 36 and the exhaust ports are disposed on the outside of the cylinder banks 36. However, this embodiment differs from the embodiment of FIGS. 3–5 in that the engine is disposed so that the cylinder banks 36 diverge forwardly toward the bow end of the watercraft rather than rearwardly. This permits the seat arrangement 49 to be narrower at the front.

In this embodiment, a water trap device 502 extends transversely across the rear of the engine 35 and receives exhaust gases from a pair of exhaust manifolds 503 which are affixed to the outside of the cylinder banks 36 in registry with their exhaust ports. Like the embodiment of FIG. 3, the water trap device 502 is divided into two chambers by an internal wall 504.

A first exhaust pipe 505 extends from the one side of the water trap device 502 adjacent the lefthand cylinder bank, crosses over and, in this embodiment, extends along the side of the tunnel 62 and exits through a discharge opening 506 formed in the transom of the lower hull portion 22 but which is still disposed close to the longitudinal center plane of the watercraft so as to obtain the advantages as aforenoted.

A second exhaust pipe 507 extends from the water trap portion 502 served by the righthand cylinder bank 306, crosses over beneath the exhaust pipe 505 forwardly of the tunnel 62 and also has a discharge end 508 that extends through the transom of the watercraft on the opposite side of the tunnel 62.

Since the water trap device 502 is positioned to the rear of the engine and its exhaust ports, in order to maintain better fore and aft balance, a fuel tank 509 is provided in the engine compartment forwardly of the engine 35. The fuel tank 509 is provided with a fill neck (not shown) which may be accessible either through a removable hatch cover or through its extension through the forward deck portion, as will be described in conjunction with the next embodiment.

In this embodiment, the area on the sides of the straddle-type seat 49 is provided with a generally flat foot area 511 so as to accommodate storage compartments, indicated generally by the reference number 512 that are disposed in the void areas previously noted. Hatch covers 513 are pivotally supported for affording access to the storage compartments 512 in what is believed to be a readily apparent manner.

Figure 21:
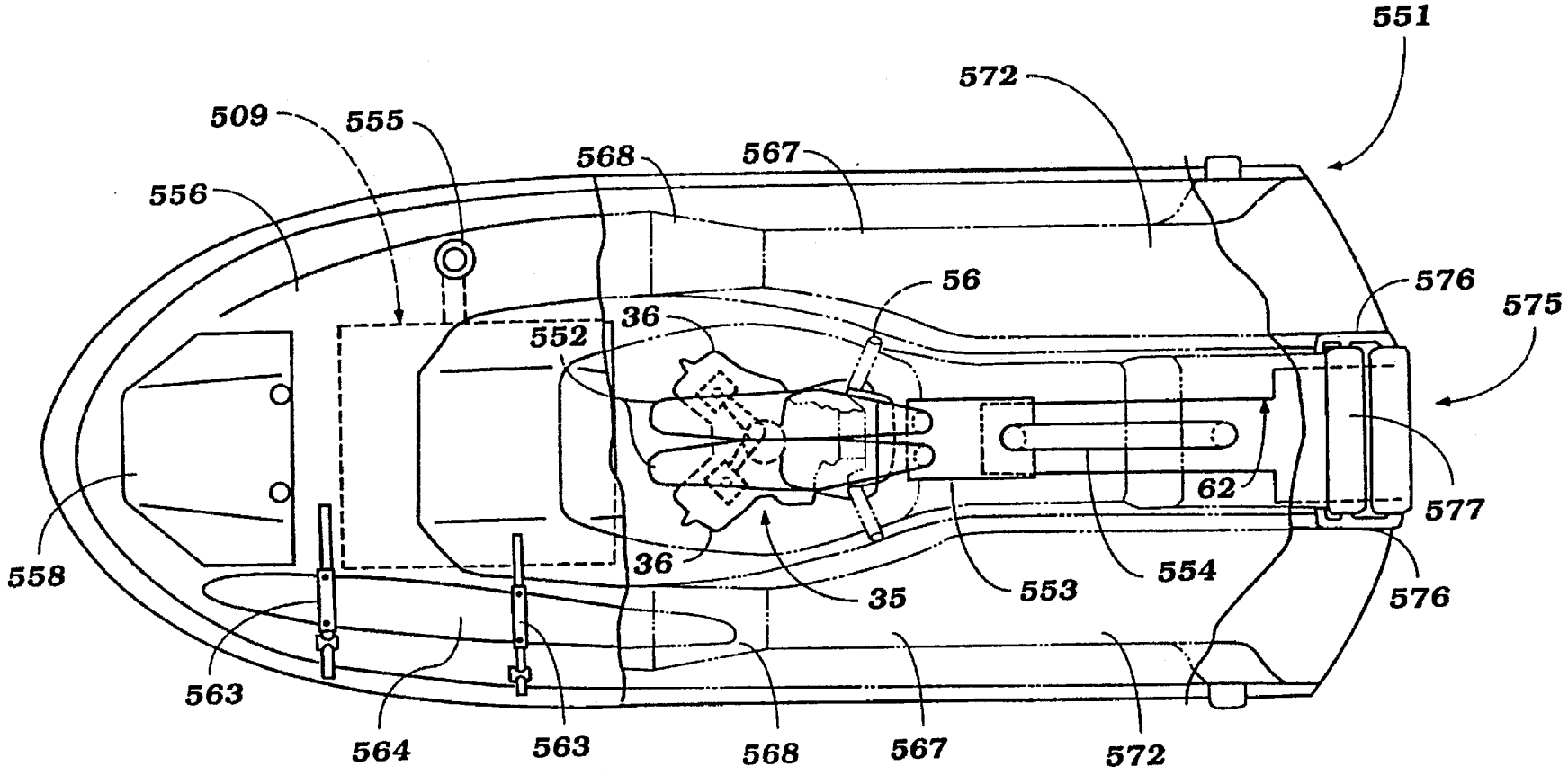
FIG. 21 is a top plan view, in part similar to FIGS. 1, 3, 5, 7, 9, 11, 13, 15, 17, and 19, with portions broken away and other portions shown in phantom, of an eleventh embodiment of the invention.
Figure 22:
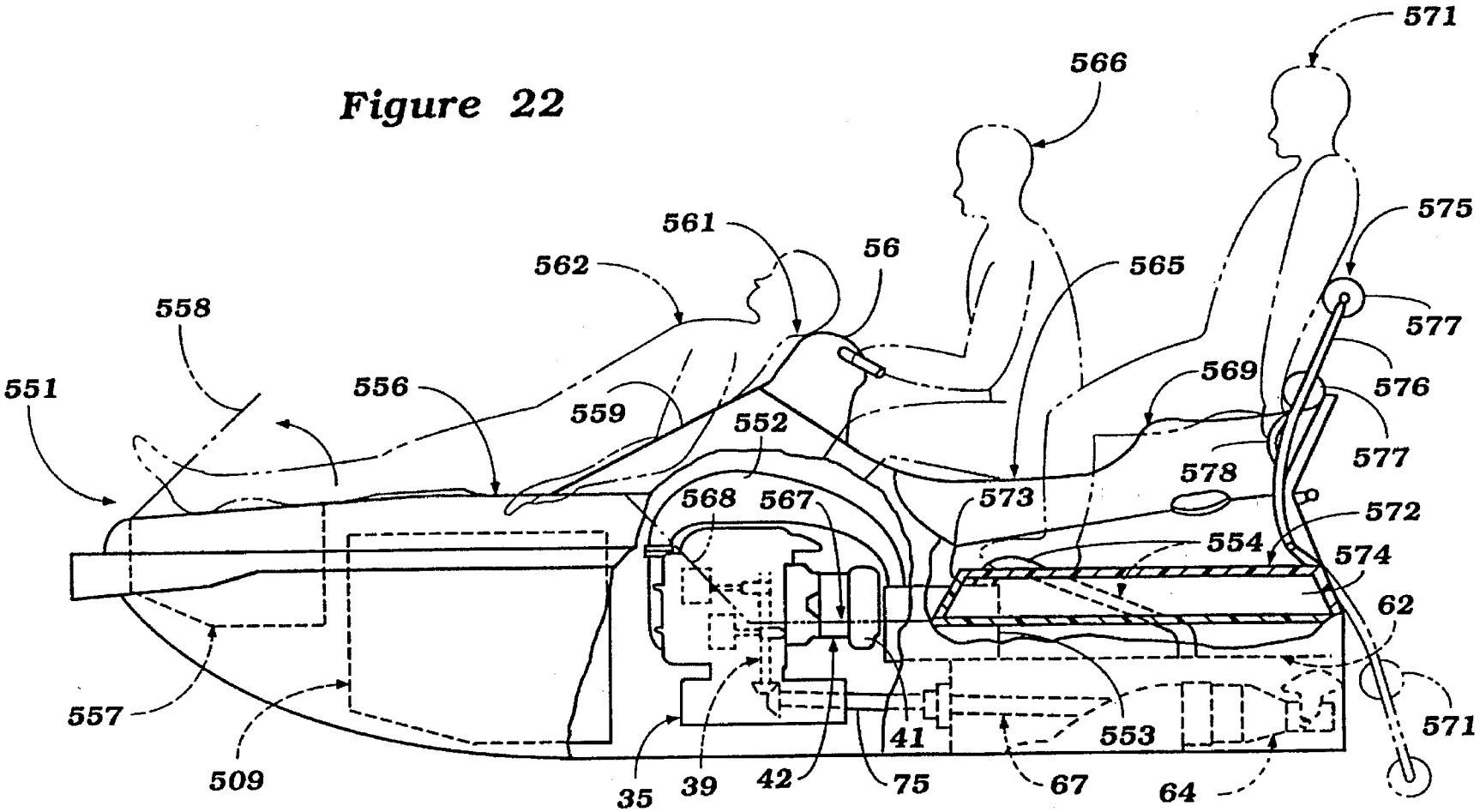
FIG. 22 is a side elevational view of this eleventh embodiment of the invention, with portions broken away and showing various positions in which riders may occupy the watercraft and also illustrating how the front storage compartment access hatch can be opened as shown in phantom lines.

The reference numeral 551 in FIGS. 21 and 22 indicate generally a personal watercraft constructed in accordance with an eleventh embodiment of the invention. This embodiment is similar to the embodiment of FIGS. 19 and 20 in that the engine 35 is disposed so that its cylinder banks 36 diverge forwardly toward the bow end of the watercraft rather than rearwardly toward the transom end of the watercraft. In this embodiment, however, the engine 35 is moved slightly more rearwardly than that of FIGS. 19 and 20 but is still positioned primarily beneath the control steering mast 56. In this arrangement, the exhaust ports of the engine are disposed in the valley between the cylinder banks 36 and the exhaust gases are delivered to a pair of expansion chamber devices 51 disposed in side-by-side relationship and which extend first forwardly and then vertically upwardly so as to pass over the top of the engine 35. This is again possible because of the fact that the steering mast 56 is positioned well above this area.

The expansion chamber devices 53 discharge the exhaust gases to a water trap device 553 which is disposed adjacent the inlet or rear end of the engine and which has a single exhaust pipe 554 extending from its upper end and terminating in a downwardly facing opening that discharges the exhaust gases into the tunnel 62. This discharge is on the longitudinal center line of the watercraft so as to provide protection against water from entering the engine through its exhaust ports.

Like the previously described embodiment, the fuel tank 509 is positioned forwardly of the engine and of the opposite side from the water trap device 553. The fill neck for the fuel tank 509 appears in this embodiment and is indicated generally by the reference numeral 555 which is accessible on one side of a generally flat forward deck portion 556. Thus, a person may easily fill the tank 509 while standing on the deck portion 556.

A storage area 557 is disposed forwardly of the hull and is accessible through a pivoted hatch 558. It will be seen in FIG. 2, that the deck portion 556 merges into an inclined portion 559 which terminates adjacent the steering mast 56. The steering mast 56 is provided with a padded portion 561 so that a person, shown in phantom and identified as 562 may lay on the deck 556 and place his head on the padded mast portion 561 for sunbathing.

One side of the deck 556 may be provided with a pair of hold down straps 563 so as to permit the carrying of a water ski 564 or the like.

This embodiment also shows a slightly different form of seating arrangement that still employs a straddle-type seat. This straddle-type seat includes a first lower portion 565 that extends rearwardly from the steering mast 56 and is designed to accommodate a rider, operator, shown in phantom at FIG. 1 at 566. A pair of generally flat foot areas 567 are disposed on opposite sides of this seat portion 565 and terminate at their forward ends in upwardly inclined portions 568 so as to accommodate the feet of a seated rider, operator.

An elevated rear passenger seat portion 569 is provided behind the seat portion 565 and at a higher level so that a passenger 571 seated thereon may see over the rider, operator's head as clearly shown in FIG. 2.

The opposite sides of the seat portion 569 are provided with raised foot areas 572 have angularly downwardly inclined forward portions 573 and which define a storage cavity 574 therebeneath. This storage cavity 574 may be accessed through either a top access hatch or through the front or rear thereof.

It has already been noted that this type of watercraft is very sporting in nature and frequently as operated by riders and passengers in swimming suits. In this embodiment, the rear of the rider's area and specifically the foot area 572 is open to the rear and there is no seatback on any of the seats. To permit a rider to enter the watercraft in the body of water in which the watercraft is operating, there provided a combined boarding ladder, backrest, indicated generally by the reference numeral 575 and which has a pair of side sections 576 that support a pair of padded steps 577. The ladder 575 may be pivoted from a backrest forming portion as shown in solid line views as shown in FIGS. 21 and 22 wherein the portions 577 are adapted to be engaged by the back of a rider 571 seated on the seat portion 569 to provide rearward support. Grab handles 578 may be provided opposite sides of the side portions 576 so as to be grasped by the hands of the rider 571.

The ladder 575 may be pivoted downwardly to the phantom line position shown in FIG. 22, wherein the step portions 577 will be disposed in the water at the upper end thereof so as to facilitate boarding of the watercraft. The grab handles 578 may also be utilized so as to facilitate this boarding operation. Therefore, it should be readily apparent that this embodiment provides ease of access to the passenger's area by providing a pivoted seatback for the rearmost passenger and which seatback is also used as a boarding ladder.

It is to be understood that the foregoing is a description of a number of preferred embodiments of the invention and that various changes and modifications may be made without departing from the spirit and scope of the invention, as defined by the appended claims.

We claim:

1. A personal type of watercraft having a hull, said hull providing a straddle-type seat adapted to carry at least one rider seated thereon in straddle fashion, a propulsion device for propelling said watercraft, and an internal combustion engine carried by said hull and having at least a pair of cylinder banks disposed at a V-angle to each other containing pistons driving a crankshaft and which crankshaft drives said propulsion device, said engine being mounted in said hull so that said crankshaft rotates about a vertically disposed axis.

2. A personal type of watercraft having a hull as set forth in claim 1, wherein the cylinder banks are disposed so as to diverge from the crankshaft axis in a direction toward the bow of said watercraft.

3. A personal type of watercraft having a hull as set forth in claim 1, wherein the cylinder banks are disposed to diverge from the crankshaft axis toward the stern of the hull.

4. A personal type of watercraft having a hull as set forth in claim 1, wherein there is provided a bevel gear transmission at the lower end of the engine providing a horizontally extending output shaft for driving the propulsion device.

5. A personal type of watercraft having a hull as set forth in claim 1, further including a control mast positioned in the hull forwardly of the seat for controlling and operation of the watercraft.

6. A personal type of watercraft having a hull as set forth in claim 5, wherein the engine is mounted in the hull beneath the control mast.

7. A personal type of watercraft having a hull as set forth in claim 6, wherein the cylinder banks are disposed so as to diverge from the crankshaft axis in a direction toward the bow of said watercraft.

8. A personal type of watercraft having a hull as set forth in claim 6, wherein the cylinder banks are disposed to diverge from the crankshaft axis toward the stern of the hull.

9. A personal type of watercraft having a hull as set forth in claim 1, wherein the engine is provided with a plurality of cylinders in each cylinder bank.

10. A personal type of watercraft having a hull as set forth in claim 1, wherein the cylinder banks contain pistons driving a crankshaft and wherein the engine is mounted in the hull so that the crankshaft rotates about a longitudinally extending axis.

11. A personal type of watercraft having a hull as set forth in claim 10, further including a control mast positioned in the hull forwardly of the seat for controlling and operation of the watercraft.

12. A personal type of watercraft having a hull as set forth in claim 11, wherein the engine is mounted in the hull beneath the control mast.

13. A personal type of watercraft having a hull as set forth in claim 11, wherein the engine is disposed beneath the seat.

14. A personal type of watercraft having a hull as set forth in claim 13, wherein the seat has a removable portion for accessing the engine.

15. A personal type of watercraft having a hull as set forth in claim 1, further comprising a pair of fuel tanks for supplying fuel to the engine, said fuel tanks being disposed on opposite sides of the straddle-type seat.

16. A personal type of watercraft having a hull as set forth in claim 15, further including conduit means interconnecting said fuel tanks with each other.

17. A personal type of watercraft having a hull as set forth in claim 16, wherein the conduit means interconnects the fuel tanks about their lower surfaces.

18. A personal type of watercraft having a hull as set forth in claim 17, further including valve means for selective control by the operator for selecting which fuel tank supplies fuel to the engine.

19. A personal type of watercraft having a hull as set forth in claim 16, further including a single fill nozzle associated with one of said fuel tanks for filling both of said fuel tanks due to their interconnection.

20. A personal type of watercraft having a hull as set forth in claim 19, wherein the single fill neck extends to the rear of the hull and is accessible externally thereof.

21. A personal type of watercraft having a hull as set forth in claim 15, further including a pair of passenger seats disposed on opposite sides of said straddle-type seat each adapted to accommodate a single rider thereon.

22. A personal type of watercraft having a hull as set forth in claim 21, wherein the fuel tanks are disposed vertically beneath the side seats.

23. A personal type of watercraft having a hull as set forth in claim 22, wherein the propulsion device is disposed between and beneath the side seats.

24. A personal type of watercraft having a hull as set forth in claim 23, further including conduit means interconnecting said fuel tanks with each other.

25. A personal type of watercraft having a hull as set forth in claim 24, wherein the conduit means interconnects the fuel tanks above their lower surfaces.

26. A personal type of watercraft having a hull as set forth in claim 25, wherein the conduit means is disposed above the propulsion device.

27. A personal type of watercraft having a hull as set forth in claim 26, wherein the conduit means is disposed at the front of the fuel tanks and fuel is drawn from the fuel tanks for the engine at the rear of the fuel tanks.

28. A personal type of watercraft having a hull as set forth in claim 27, further including valve means for selective control by the operator for selecting which fuel tank supplies fuel to the engine.

29. A personal type of watercraft having a hull as set forth in claim 28, further including a single fill nozzle associated with one of said fuel tanks for filling both of said fuel tanks due to their interconnection.

30. A personal type of watercraft having a hull as set forth in claim 29, wherein the single fill neck extends to the rear of the hull and is accessible externally thereof.

31. A personal type of watercraft having a hull as set forth in claim 1, further including a pair of passenger seats disposed on opposite sides of said straddle-type seat each adapted to accommodate a single rider thereon.

32. A personal type of watercraft having a hull as set forth in claim 31, wherein the straddle-type seat has sufficient length to accommodate at least two riders seated thereon in tandem straddle fashion.

33. A personal type of watercraft having a hull as set forth in claim 1, wherein the propulsion device is provided at the rear of the hull and at a level below the straddle-type seat.

34. A personal type of watercraft having a hull as set forth in claim 33, wherein the underside of the hull is provided with a tunnel with the propulsion device being disposed at least in part within the tunnel.

35. A personal type of watercraft having a hull as set forth in claim 34, wherein the propulsion device comprises a jet propulsion unit.

36. A personal type of watercraft having a hull as set forth in claim 35, wherein the forward end of the tunnel is defined by a first bulkhead carrying a first bearing journalling a driveshaft for driving said jet propulsion unit from the engine and further including a second bulkhead disposed rearwardly of the engine and defining the rear end of an engine compartment within the hull in which the engine is positioned and further including a second bearing carried by said second bulkhead for journalling said driveshaft.

37. A personal type of watercraft having a hull as set forth in claim 35, further including a pair of passenger seats disposed on opposite sides of said straddle-type seat each adapted to accommodate a single rider thereon.

38. A personal type of watercraft having a hull as set forth in claim 37, further comprising a pair of fuel tanks for supplying fuel to the engine, said fuel tank being disposed on opposite sides of the straddle-type seat.

39. A personal type of watercraft having a hull as set forth in claim 38, wherein the fuel tanks are disposed vertically beneath the side seats.

40. A personal type of watercraft having a hull as set forth in claim 39, further including conduit means interconnecting said fuel tanks with each other.

41. A personal type of watercraft having a hull as set forth in claim 40, wherein the conduit means interconnects the fuel tanks above their lower surfaces.

42. A personal type of watercraft having a hull as set forth in claim 41, further including valve means for selective control by the operator for selecting which fuel tank supplies fuel to the engine.

43. A personal type of watercraft having a hull as set forth in claim 42, further including a single fill nozzle associated with one of said fuel tanks for filling both of said fuel tanks due to their interconnection.

44. A personal type of watercraft having a hull as set forth in claim 1, wherein the hull is provided with a deck forwardly of the straddle-type seat and a steering mast disposed forwardly of the seat and rearwardly Of the deck, said deck offering sufficient length so as to accommodate a passenger lying thereon.

45. A personal type of watercraft having a hull as set forth in claim 44, wherein the steering mast is padded so as to form a head cushion for a lying passenger on the deck.

46. A personal type of watercraft having a hull, said hull providing a straddle-type seat adapted to carry at least one rider seated thereon in straddle fashion, a propulsion device for propelling said watercraft, an internal combustion engine carried by said hull and driving said propulsion device, a pair of fuel tanks carried by said hull on opposite sides of a longitudinal center line thereof, and means for delivering fuel from said fuel tanks to said engine for its operation.

47. A personal type of watercraft having a hull, said hull providing a straddle-type seat adapted to carry at least one rider seated thereon in straddle fashion, a propulsion device for propelling said watercraft, an internal combustion engine carried by said hull and driving said propulsion device, and a pair of passenger side seats each disposed on a respective side of said straddle-type seat at the rear thereof and at a substantially different level so that passengers seated on said side seats will be seated at a different height than an operator seated on said straddle-type seat.

48. A personal type of watercraft having a hull as set forth in claim 47, wherein the pair of side seats are disposed below the straddle-type seat.

49. A personal type of watercraft having a hull as set forth in claim 48, wherein the straddle-type seat extends rearwardly between the side seats so as to provide side rests for passengers seated on the side seats.

50. A personal type of watercraft having a hull as set forth in claim 49, wherein the hull further defines a pair of foot areas on the sides of the straddle-type seat and forwardly of the side seats for accommodating the feet of riders seated on the seats.

51. A personal type of watercraft having a hull as set forth in claim 50, wherein the floor areas have upwardly inclined portions for accommodating the feet of at least one rider.

52. A personals type of watercraft having a hull as set forth in claim 51, further including a second pair of upwardly inclined portions of the foot area spaced from the first upwardly inclined portions.

53. A personal type of watercraft having a hull as set forth in claim 48, wherein the side seats are disposed rearwardly of the tandem-type seat.

54. A personal type of watercraft having a hull as set forth in claim 47, wherein the hull is formed with a pair of foot areas disposed on opposite sides of the straddle-type seat adapted to accommodate the feat of a rider seated thereon.

55. A personal type of watercraft having a hull as set forth in claim 54, wherein the hull is provided with a storage area disposed beneath at least one of the foot areas.

56. A personal type of watercraft having a hull as set forth in claim 55, further including an access hatch affording access to the storage compartment.

57. A personal type of watercraft having a hull as set forth in claim 56, wherein there are provided a pair of storage compartments and access hatches in both of the foot areas.

58. A personal type of watercraft having a hull as set forth in claim 54, wherein the straddle-type seat has sufficient length so as to accommodate a pair of riders seated thereon in straddle tandem fashion and wherein the foot areas extend along the entire length of the straddle type seat.

59. A personal type of watercraft having a hull as set forth in claim 58, wherein the rear portion of the straddle type seat is raised relative to the front portion and the foot area on the sides of the rear portion are raised relative to the front portion and for the storage areas.

60. A personal type of watercraft having a hull as set forth in claim 47, wherein the underside of the hull is provided with a tunnel at the rear end thereof and wherein the propulsion device comprises a jet propulsion unit disposed at least in part within the tunnel.

61. A personal type of watercraft having a hull as set forth in claim 60, wherein the pair of side seats are disposed below the straddle-type seat.

62. A personal type of watercraft having a hull as set forth in claim 61, wherein the straddle-type seat extends rearwardly between the side seats so as to provide side rests for passengers seated on the side seats.

63. A personal type of watercraft having a hull as set forth in claim 62, wherein the hull further defines a pair of foot areas on the sides of the straddle-type seat and forwardly of the side seats for accommodating the feet of riders seated on the seats.

64. A personal type of watercraft having a hull as set forth in claim 63, wherein the floor areas have upwardly inclined portions for accommodating the feet of at least one rider.

65. A personal type of watercraft having a hull as set forth in claim 64, further including a second pair of upwardly inclined portions of the foot area spaced from the first upwardly inclined portions.

66. A personal type of watercraft having a hull as set forth in claim 61, wherein the side seats are disposed rearwardly of the tandem-type seat.

67. A personal type of watercraft having a hull as set forth in claim 60, wherein the hull is formed with a pair of foot areas disposed on opposite sides of the straddle-type seat adapted to accommodate the feet of a rider seated thereon.

68. A personal type of watercraft having a hull as set forth in claim 67, wherein the hull is provided with a storage area disposed beneath at least one of the foot areas.

69. A personal type of watercraft having a hull is set forth in claim 68, further including an access hatch affording access to the storage compartment.

70. A personal type of watercraft having a hull as set forth in claim 69, wherein there are provided a pair of storage compartments and access hatches in both of the foot areas.

71. A personal type of watercraft having a hull as set forth in claim 68, wherein the straddle-type seat has sufficient length so as to accommodate a pair of riders seated thereon in straddle tandem fashion and wherein the foot areas extend along the entire length of the straddle type seat.

72. A personal type of watercraft having a hull as set forth in claim 71, wherein type rear portion of the straddle type seat is raised relative to the front portion and the foot area on the sides of the rear portion are raised relative to the front portion and form the storage areas.

73. A personal type of watercraft having a hull as set forth in claim 47, wherein the engine is disposed beneath the straddle-type seat.

74. A personal type of watercraft having a hull as set forth in claim 73, wherein the straddle-type seat has a removable cushion portion for affording access to the engine.

75. A personal type of watercraft having a hull as set forth in claim 74, wherein the engine is supported within the hull so that its output shaft rotates about a vertically extending axis.

76. A personal type of watercraft having a hull as set forth in claim 75, wherein the engine has a pair of cylinder banks disposed at a V angle to each other with the cylinder banks diverging from each other from the engine output shaft toward the how of the hull.

77. A personal type of watercraft having a hull as set forth in claim 75, wherein the engine has a pair of cylinder banks disposed at a V angle of each other and the cylinder banks diverge from the output shaft toward the stern of the hull.

78. A watercraft comprised of a hull as set forth in claim 75, further including an engine positioned within the hull beneath the raised central seat and driving a propulsion device carried by the engine for propelling the watercraft.

79. A watercraft comprised of a hull as set forth in claim 78, wherein a portion of the seat is removable for accessing the engine.

80. A watercraft comprised of a hull as set forth in claim 79, wherein the engine is disposed within the hull so that its output shaft rotates about a vertically disposed axis.

81. A watercraft comprised of a hull as set forth in claim 80, wherein the engine is a V-type engine having a pair of angularly disposed cylinder banks.

82. A watercraft comprised of a hull as set forth in claim 81, wherein the cylinder banks diverge from each other toward the bow of the watercraft.

83. A watercraft comprised of a hull as set forth in claim 81, wherein the cylinder banks diverge from each other toward the stern of the watercraft.

84. A watercraft comprised of a hull defining a rider's area having a raised central seat for accommodating at least one rider seated thereon in straddle fashion, a pair of foot areas on opposite sides of said seat on which a rider may place his feet, and at least one storage compartment disposed beneath at least one of said foot areas.

85. A watercraft comprised of a hull as set forth in claim 84, wherein the hull further has a pair of raised gunnels disposed outwardly of the foot areas.

86. A watercraft comprised of a hull as set forth in claim 84, wherein there are provided storage compartments beneath both of the foot areas.

87. A watercraft comprised of a hull as set forth in claim 86, further including an access hatch affording access to the storage compartment.

88. A watercraft comprised of a hull as set forth in claim 84, wherein comprising a hatch cover for accessing the storage area and disposed in flush relationship with the foot area when closed.

89. A watercraft comprised of a hull as set forth in claim 84, wherein at least a portion of the foot area is raised relative to the remainder of the foot area, and the storage compartment is formed under the raised foot area.

90. A watercraft comprised of a hull as set forth in claim 89, wherein the central seat has sufficient length so as to accommodate a pair of riders seated thereon in straddle tandem fashion, and the raised foot area is adjacent the rear portion of the seat.

91. A watercraft comprised of a hull as set forth in claim 90, wherein the rear portion of the seat is substantially higher than the front portion of the seat so that a rider seated thereon may see over the head of a rider seated on the front portion of the seat.

92. A watercraft comprised of a hull defining a tunnel at the rear end thereof on its under side, a rider's area disposed above said tunnel in the upper portion of said hull, a straddle-type seat positioned centrally of said rider's area and adapted to accommodate at least one rider in straddle fashion, a pair of foot areas defined at the lower portion of said rider's area for receiving the feet of a rider seated upon said seat, a jet propulsion unit disposed at least in part in said tunnel and having an impeller shaft, said tunnel being defined at the forward end thereof by a first bulkhead, an engine compartment formed forwardly of said tunnel and defined at the rear end thereof by a second bulkhead, an engine in said engine compartment and having an output shaft, a drive shaft coupled at one end to said engine output shaft and at the other end to said impeller shaft for driving said impeller shaft from said engine output shaft, and first and second bearings supported by said first and said second bulkheads, respectively, for journalling said drive shaft.

93. A watercraft comprised of a hull as set forth in claim 92, wherein the cylinder banks are disposed at a V-angle to each other.

94. A watercraft comprised of a hull as set forth in claim 93, further comprising a pair of fuel tanks for supplying fuel to the engine, said fuel tank being disposed on opposite sides of the straddle-type seat.

95. A watercraft comprised of a hull as set forth in claim 94, further including conduit means interconnecting said fuel tanks with each other.

96. A watercraft comprised of a hull as set forth in claim 95, further including valve means for selective control by the operator for selecting which fuel tank supplies fuel to the engine.

97. A watercraft comprised of a hull as set forth in claim 95, further including a single fill nozzle associated with one of said fuel tanks for filling both of said fuel tanks due to their interconnection.

98. A watercraft comprised of a hull as set forth in claim 97, wherein the single fill neck extends to the rear of the hull and is accessible externally thereof.

99. A watercraft comprised of a hull as set forth in claim 98, further including means defining a deck at the rear of the hull with the fill neck being disposed at one side of the deck for filling of the fuel tanks by an operator standing on said deck.

100. A watercraft comprised of a hull defining a rider's area at the rear thereof, a steering control positioned at a forward portion of said rider's area for steering of said watercraft by a rider in said rider's area, a deck extending forwardly from said steering control and configured to accommodate a lying passenger, and cushioning means associated with said steering control on which said lying passenger may rest his head.

* * * * *